US011840795B2

(12) United States Patent
Lee et al.

(10) Patent No.: US 11,840,795 B2
(45) Date of Patent: Dec. 12, 2023

(54) CLOTHES CARE APPARATUS AND CONTROL METHOD THEREFOR

(71) Applicant: LG ELECTRONICS INC., Seoul (KR)

(72) Inventors: Ayeong Lee, Seoul (KR); Jeongjoon Roh, Seoul (KR); Jihyun Yoon, Seoul (KR); Taehee Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 74 days.

(21) Appl. No.: 17/434,197

(22) PCT Filed: Feb. 28, 2020

(86) PCT No.: PCT/KR2020/002901
§ 371 (c)(1),
(2) Date: Aug. 26, 2021

(87) PCT Pub. No.: WO2020/175959
PCT Pub. Date: Sep. 3, 2020

(65) Prior Publication Data

US 2022/0170200 A1 Jun. 2, 2022

(30) Foreign Application Priority Data

Feb. 28, 2018 (KR) ..... 10-2019-0024365
Feb. 28, 2019 (KR) ..... 10-2019-0024362

(51) Int. Cl.
*D06F 73/02* (2006.01)

(52) U.S. Cl.
CPC ..... *D06F 73/02* (2013.01)

(58) Field of Classification Search
CPC ..... D06F 73/02
See application file for complete search history.

(56) References Cited

U.S. PATENT DOCUMENTS 3,732,628 A * 5/1973 Blevens ..... D06F 73/02 34/470
3,805,561 A * 4/1974 Bullock ..... D06F 73/02 223/51

(Continued)

FOREIGN PATENT DOCUMENTS

CN 106283570 A 1/2017
CN 108611828 A 10/2018

(Continued)

OTHER PUBLICATIONS

Machine translation of Office Action in KR 1020190024365, dated Sep. 5, 2023. (Year: 2023).*

(Continued)

*Primary Examiner* — Benjamin L Osterhout
(74) *Attorney, Agent, or Firm* — Birch, Stewart, Kolasch & Birch, LLP

(57) ABSTRACT

A clothing processing apparatus according to an embodiment of the present disclosure may include a cabinet having a receiving space formed therein, in which clothing is received, a holder configured to be located in the receiving space to hold a clothing supporter configured to support the clothing, a steamer configured to spray steam toward the clothing while elevating inside the receiving space in the vertical direction, an elevating motor configured to provide an elevating power of the steamer, and a tilting motor configured to rotate the holder so that the arm of the clothing droops downward to be separated from the body.

19 Claims, 23 Drawing Sheets

(56) References Cited

U.S. PATENT DOCUMENTS

| | | | | |
|---|---|---|---|---|
| 4,645,101 | A | 2/1987 | Müller | |
| 5,305,484 | A * | 4/1994 | Fitzpatrick | D06F 73/02 68/6 |
| 9,765,474 | B1 | 9/2017 | Bergman | |
| 2010/0043500 | A1* | 2/2010 | Yoo | D06F 73/02 68/5 C |
| 2012/0317729 | A1* | 12/2012 | Song | D06F 58/10 68/6 |
| 2014/0238086 | A1* | 8/2014 | Choi | D06F 58/20 68/20 |
| 2014/0317948 | A1 | 10/2014 | Lee et al. | |
| 2020/0040504 | A1 | 2/2020 | Rochford et al. | |

FOREIGN PATENT DOCUMENTS

| | | | |
|---|---|---|---|
| CN | 108660729 | A | 10/2018 |
| JP | 50-142890 | A | 11/1975 |
| JP | 2018-143744 | A | 9/2018 |
| KR | 10-2006-0102991 | A | 9/2006 |
| KR | 10-2006-0111128 | A | 10/2006 |
| KR | 10-2007-0109319 | A | 11/2007 |
| KR | 10-2009-0059358 | A | 6/2009 |
| KR | 10-2010-0098431 | A | 9/2010 |
| KR | 10-2010-0100501 | A | 9/2010 |
| KR | 10-2011-0048343 | A | 5/2011 |
| KR | 10-2011-0099913 | A | 9/2011 |
| KR | 10-2011-0099914 | A | 9/2011 |
| KR | 20-2013-0005234 | U | 9/2013 |
| KR | 10-142557 | B1 | 8/2014 |
| KR | 10-1608655 | B1 | 4/2016 |
| KR | 10-2018-0037459 | A | 4/2018 |
| WO | WO 2018/192175 | A1 | 10/2018 |

OTHER PUBLICATIONS

Machine translation of Office Action in KR 1020190024362, dated Aug. 29, 2023. (Year: 2023).*

International Search Report in International Application No. PCT/KR2020/002901 (4 pages).

* cited by examiner

CLOTHES CARE APPARATUS AND CONTROL METHOD THEREFOR

CROSS-REFERENCE TO RELATED APPLICATIONS

This application is a U.S. National Phase of PCT International Application No. PCT/KR2020/002901, filed on Feb. 28, 2020, which claims priority under 35 U.S.C. 119(a) to Patent Application No. 10-2019-0024362, filed in the Republic of Korea on Feb. 28, 2019 and to Patent Application No. 10-2019-0024365, filed in the Republic of Korea on Feb. 28, 2019, the contents of all of which are hereby incorporated by reference herein in their entireties.

TECHNICAL FIELD

The present disclosure relates to a clothing processing apparatus, and more particularly, to a clothing processing apparatus and a method for controlling the same for refreshing clothing.

BACKGROUND

In general, a washing machine is widely used as a device for washing articles made of fabrics such as clothing or bedding, and the washing machine washes the laundry through friction between the laundry water and the laundry received in a water tank, so that separate dehydration, drying process, and the like were additionally required.

Recently, as a device for processing or managing clothing more conveniently than the conventional washing machine, there are clothing processing apparatus are used, which has functions such as removing wrinkles from clothing or removing dust or odors from clothing without a separate washing process through washing water.

The clothing processing apparatus of the prior art (KR 10-2011-0099914A, KR 10-2011-0048343A, and KR10-2018-0037459A) employ a scanning method of spraying steam while moving along the surface of clothing to remove wrinkles from clothing. However, the scan-type clothing processing apparatus of the prior art has a problem in that it is insufficient to process the arm part of the clothing. In more detail, when the top is hung on a clothing hanger, the arm part overlaps the body part and remains in a state of being wrinkled. In this state, there is a problem in that more severe and strong wrinkles are obtained when the clothing processing of the arm part is performed.

Another clothing processing apparatus of the prior art (KR10-2010-0100501A) discloses the processing of the arm part of a shirt, but there is a problem that it is unsuitable for home use because the apparatus requires a worker's work and occupies a large space when the arm is spread out.

Technical Problem

An object to be solved by the present disclosure is to provide a clothing processing apparatus and a method for controlling the same for refreshing clothing so that wrinkles do not form in a portion where an arm and a body of the clothing overlap.

Another object to be solved by the present disclosure is to provide a compact clothing processing apparatus.

Another object to be solved by the present disclosure is to provide a clothing processing apparatus in which steam is smoothly sprayed.

Technical Solution

The clothing processing apparatus according to an embodiment of the present invention can rotate the holder on which the clothing supporter is held to separate the arms of the clothing from the body and droop them downward, and in this state, the steamer can spray steam while being elevated in the vertical direction. In this way, the arm can be effectively refreshed without wrinkles.

In more detail, a clothing processing apparatus according to an embodiment of the present disclosure may include a cabinet having a receiving space formed therein, in which clothing is received, a holder configured to be located in the receiving space to hold a clothing supporter configured to support the clothing, a steamer configured to spray steam toward the clothing while elevating inside the receiving space in the vertical direction, an elevating motor configured to provide an elevating power of the steamer, and a tilting motor configured to rotate the holder so that the arm of the clothing droops downward to be separated from the body.

The clothing supporter may include a hanging part on which clothing is hung, a ring configured to suspend the hanging part on the holder so that the clothing supporter rotates together with the holder, and a side frame configured to extend downward from the hanging part and to support both sides of the body of the clothing from an inner portion thereof.

The clothing processing apparatus may further include a controller configured to control the tilting motor to rotate the holder in a direction in which the arm of the clothing droops downward and to control the elevating motor so that the steamer elevates in a state where the arm of the clothing droops downward.

A method for controlling a clothing processing apparatus according to an embodiment of the present disclosure may include a first arm alignment step of rotating the holder in one direction so that one of both arms of the clothing that is hung on the clothing supporter is separated from the body and droops downward, a first arm scanning step in which the steamer sprays steam while elevating in the vertical direction in a state where the one arm droops downward, a second arm alignment step in which the holder rotates in the other direction so that the other one of both arms of the clothing is separated from the body and droops downward, and a second arm scanning step in which the steamer sprays steam while elevating in the vertical direction in a state where the other arm droops downward.

The method for controlling a clothing processing apparatus may further include a body scanning step in which the steamer sprays steam while elevating in the vertical direction in a state where the body of the clothing droops downward. The body scanning step may be performed before the first arm alignment step or performed after the second arm scanning step.

The clothing processing apparatus according to another embodiment of the present disclosure may move a pair of separators in the left and right direction to separate the arms of the clothing from the body so that the arms can droop downward, and in this state, the steamer may spray steam while being elevated in the vertical direction. Accordingly, the arm may be effectively refreshed without wrinkles.

A clothing processing apparatus according to an embodiment of the present disclosure may include a cabinet having a receiving space formed therein, in which clothing is received, a holder configured to be located in the receiving space to hold a clothing supporter configured to support the clothing, a steamer configured to spray steam toward the clothing while elevating inside the receiving space in the vertical direction, an elevating motor configured to provide an elevating power of the steamer, a separator configured to move in the left and right direction and to move between the body and arms of the clothing to separate the body and arms of the clothing, and a moving motor that moves the separator in the left and right direction.

A pair of separators spaced apart from each other in the left and right direction may be provided.

The separator may include a moving body configured to move in the left and right direction by the moving motor, a moving bar formed long upward from the moving body, and a separate part located at the upper end of the moving bar and formed long in the front and rear direction.

The clothing processing apparatus may further include a guide rail configured to be disposed long on the inner bottom surface of the cabinet in the left and right direction to guide the movement of the moving body in the left and right direction.

The moving body may include a main body to which the moving bar is connected, and a guide block positioned below the main body and having a guide groove into which the guide rail is fitted formed therein.

The clothing processing apparatus may further include a rotation pulley configured to be connected to the moving motor, a support pulley configured to be spaced apart from the rotation pulley, and a belt configured to be connected to the rotation pulley and the support pulley to form a closed curve, in which the separator may be provided with a belt holder for holding the belt.

The clothing processing apparatus may further include a controller configured to control the moving motor to separate one arm from the body of the clothing and to control the elevating motor to elevate the steamer in a state where the one arm is separated from the body.

A method for controlling a clothing processing apparatus according to an embodiment of the present disclosure may include a separation step in which a pair of separators move in a direction away from each other and respectively move between the arm and the body of the clothing, a first arm alignment step of moving at least one of the pair of separators in one direction so that one arm of the clothing is separated from the body and droops downward, a first arm scanning step in which the steamer sprays steam while elevating in the vertical direction in a state where one arm is separated from the body and droops downward, a second arm alignment step of moving at least one of the pair of separators in the other direction so that the other arm of the clothing is separated from the body and droops downward, and a second arm scanning step in which the steamer sprays steam while elevating in the vertical direction in a state where the other arm is separated from the body and droops downward.

The method for controlling a clothing processing apparatus may further include a body alignment step in which the pair of separators moves in a direction away from each other so that the body of the clothing is separated from both arms and droops downward, and a body scanning step in which the steamer sprays steam while elevating in the vertical direction in a state where the body is separated from both arms.

The body alignment step may be performed after the second arm scanning step.

In a clothing processing apparatus according to an embodiment of the present disclosure, the steam guide tube may be disposed long in a vertical direction and may have a variable length. Accordingly, the steamer can be smoothly elevated, and the water condensed in the steam guide tube does not accumulate in the steam guide tube, but falls to the steam generator and may be reheated with steam.

In more detail, a clothing processing apparatus according to an embodiment of the present disclosure may include a cabinet having a receiving space formed therein, in which clothing is received, a steamer configured to spray steam toward the clothing while moving inside the receiving space in the vertical direction, an elevating motor configured to provide an elevating power of the steamer, a steam generator configured to be positioned below the steamer and to generate steam supplied to the steamer, and a steam guide tube which is formed long in the vertical direction, connects the steam generator and the steamer, and the length of which varies according to the elevation of the steamer.

The steam guide tube may have a multi-stage structure of variable length.

The steam guide tube may include an inlet guide tube connected to the steam generator, an outlet guide tube connected to the steamer and configured to elevate together with the steamer, and a connection guide tube configured to connect the inlet guide tube and the outlet guide tube and to move with respect to the inlet guide tube and the outlet guide tube in the vertical direction.

A first through-hole through which the connection guide tube passes may be formed on the upper end of the inlet guide tube, and a second through-hole through which the outlet guide tube passes may be formed on the upper end of the connection guide tube.

A first sealing in contact with the outer circumference of the connection guide tube may be provided on the inner circumference of the first through-hole, and a second sealing in contact with the outer circumference of the outlet guide tube may be provided on the inner circumference of the second through-hole.

A first hanging part hung in the lower end circumferential portion of the first through-hole may be formed on the lower end of the connection guide tube, and a second hanging part hung in the lower end circumferential portion of the second through-hole may be formed on the lower end of the outlet guide tube.

The inner diameter of the inlet guide tube may be greater than the outer diameter of the connection guide tube, and the inner diameter of the connection guide tube may be greater than the outer diameter of the outlet guide tube.

The steam guide tube may be vertically disposed.

In the cabinet, a machine room may be further formed, which is located below the receiving space, in which the steam generator is disposed, and which is partitioned from the receiving space by a partition plate.

The partition plate may have a through-hole through which the steam guide tube passes.

DETAILED DESCRIPTION

Reference will now be made in detail to the embodiments of the present disclosure, examples of which are illustrated in the accompanying drawings.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense.

Also, in the description of embodiments, terms such as first, second, A, B, (a), (b) or the like may be used herein when describing components of the present invention. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

Hereinafter, specific embodiments of the present disclosure will be described in detail with drawings.

In the present specification, a refresher for refreshing clothing as a clothing processing apparatus is described, but the present disclosure is not limited thereto and the inventive concept may be applied to other devices that may include a heat pump to be described later.

Here, the term "refresh" may mean a process of performing removing wrinkles, deodorizing, sanitizing, preventing static electricity, warming of clothing or the like by supplying air, heated air, or the like to clothing or providing water, mist, steam, or the like (hereinafter collectively referred to as 'steam' for convenience) to clothing. In addition, the clothing referred to in this specification includes not only clothing and apparel, but also objects that can be worn by a person, such as shoes, socks, gloves, hats, and scarves, as well as objects that can be used by a person such as dolls, towels, and blankets, and includes all objects that can perform washing.

Figure 1:
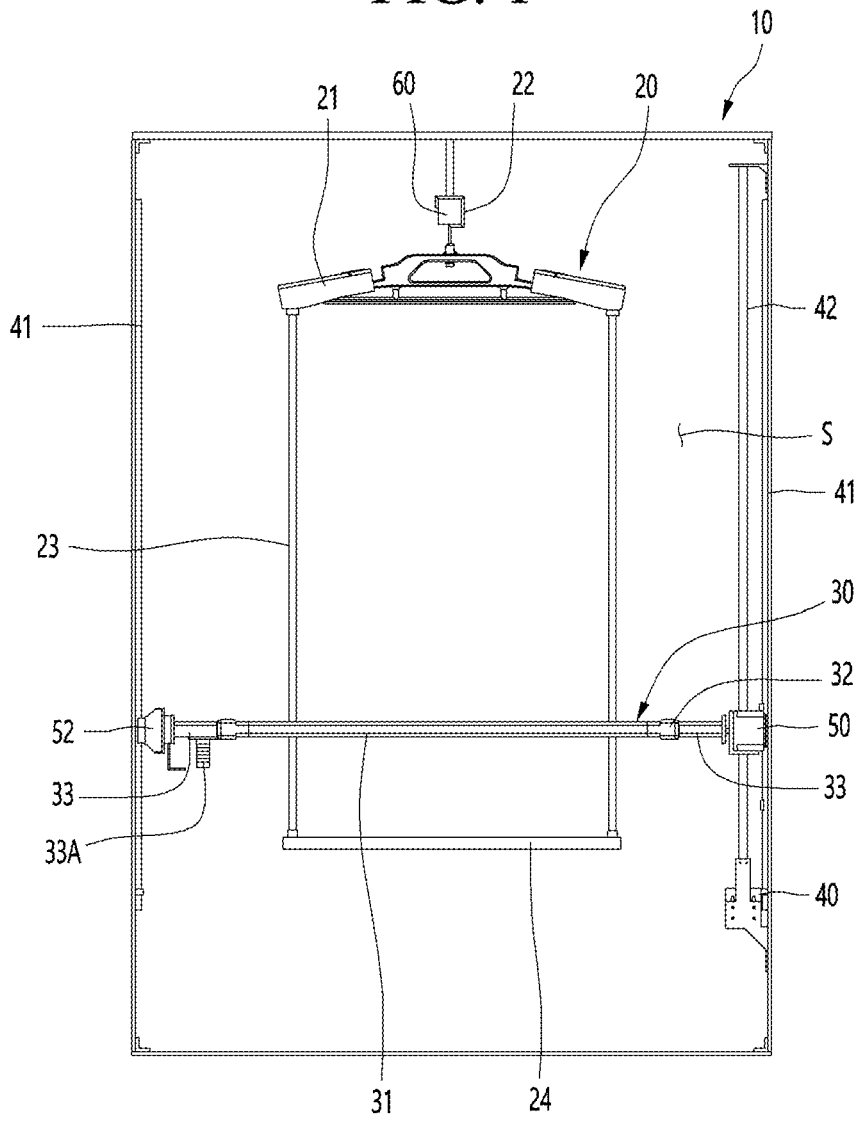
FIG. 1 is a front view illustrating a clothing processing apparatus according to a first embodiment of the present disclosure.
Figure 2:
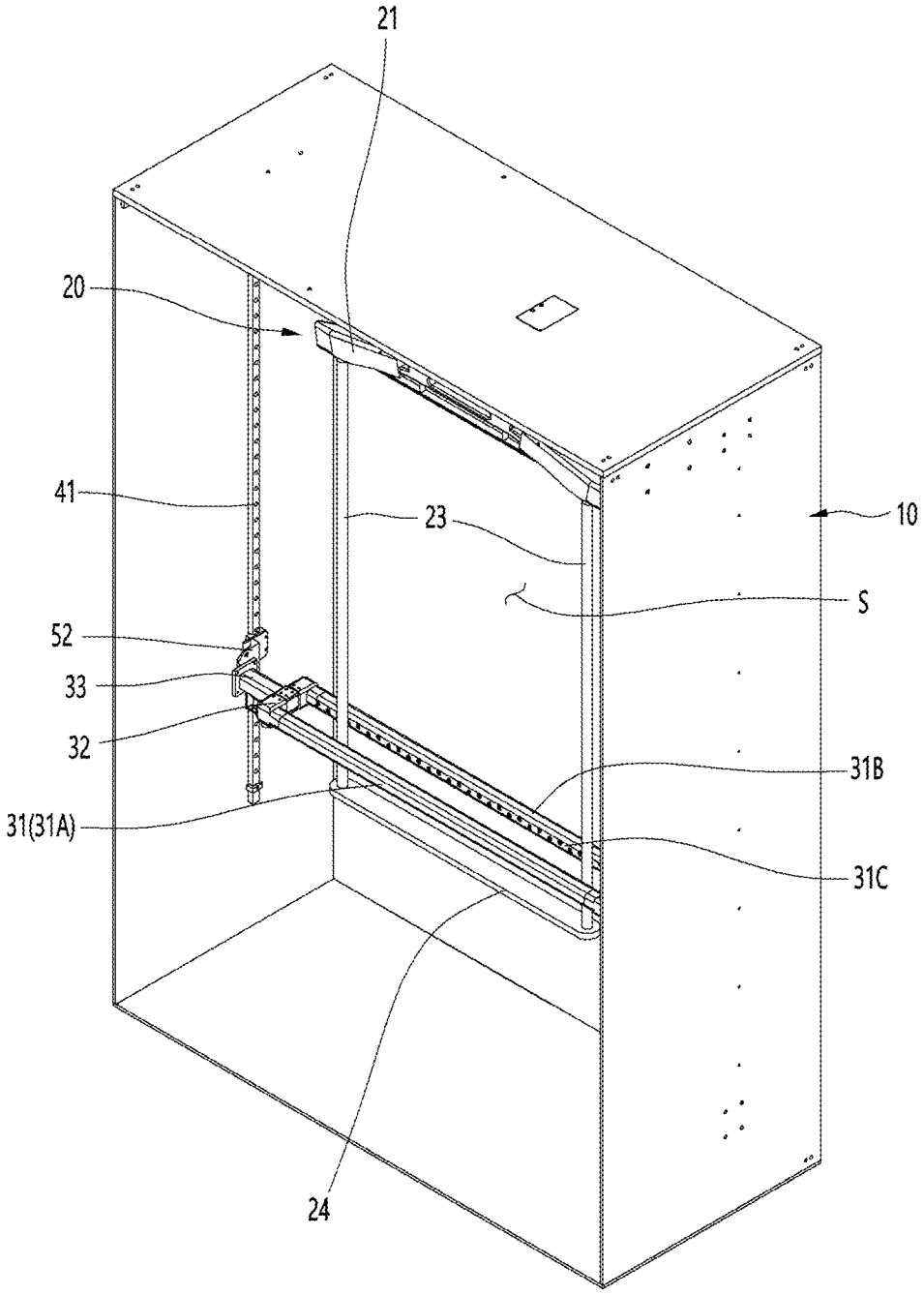
FIG. 2 is a perspective view illustrating a clothing processing apparatus according to a first embodiment of the present disclosure.
Figure 3:
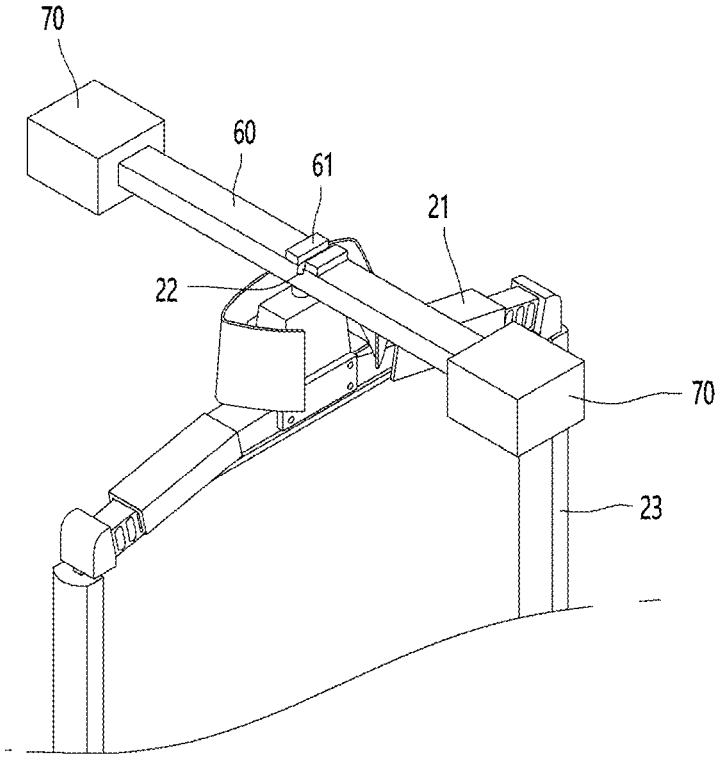
FIG. 3 is a view illustrating a holder according to a first embodiment of the present disclosure.
Figure 4:
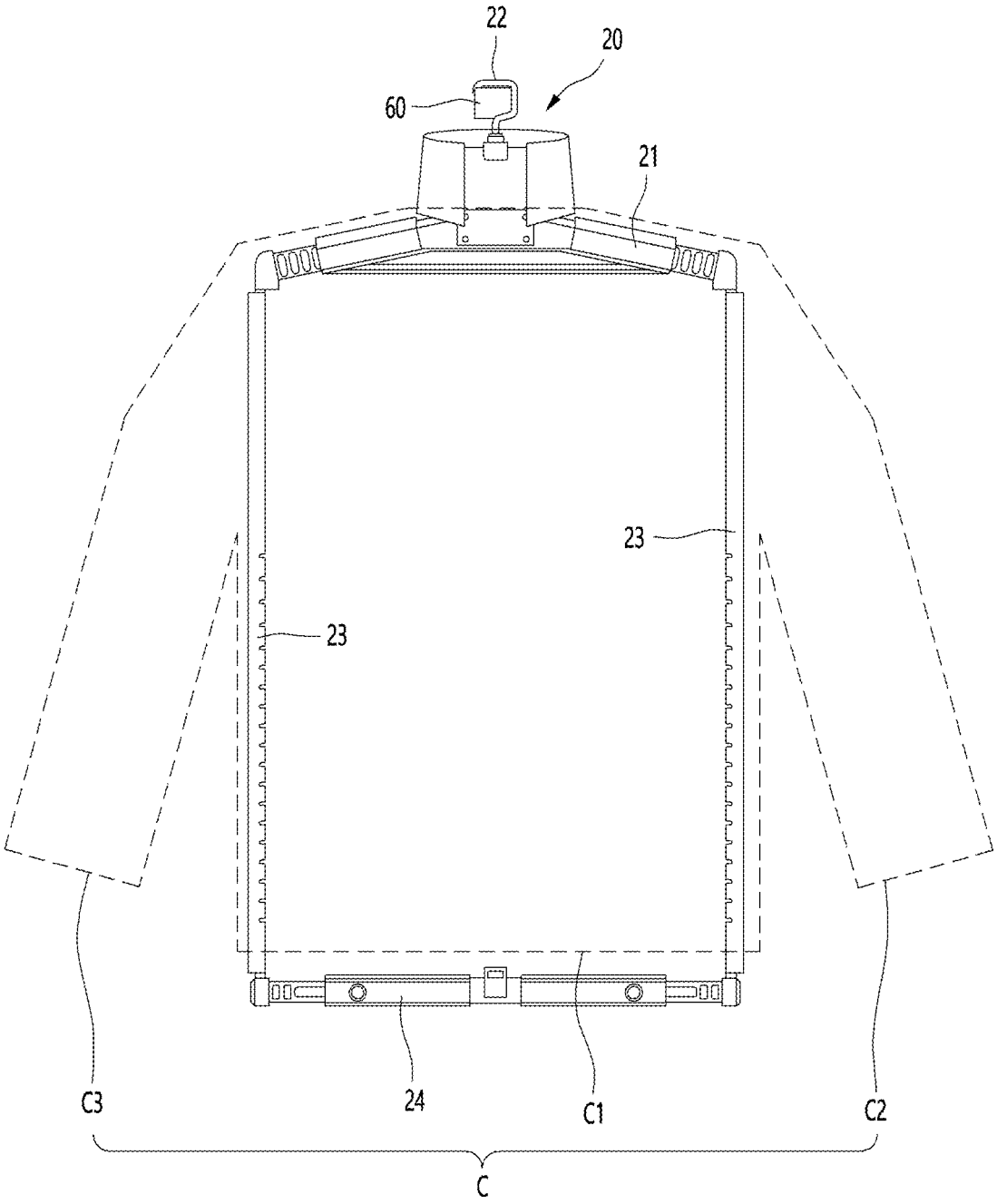
FIG. 4 is a view illustrating a clothing supporter held on a holder according to a first embodiment of the present disclosure.

FIG. 1 is a front view illustrating a clothing processing apparatus according to a first embodiment of the present disclosure, FIG. 2 is a perspective view illustrating a clothing processing apparatus according to a first embodiment of the present disclosure, FIG. 3 is a view illustrating a holder according to a first embodiment of the present disclosure, and FIG. 4 is a view illustrating a clothing supporter held on a holder according to a first embodiment of the present disclosure.

The clothing processing apparatus according to the present embodiment may include a cabinet 10 in which a receiving space S for receiving clothing is formed.

The cabinet 10 may form the outer appearance of the clothing processing apparatus. The cabinet 10 may have a substantially rectangular box shape but is not limited thereto.

The clothing processing apparatus may further include a machine room (not illustrated). The machine room may be located inside or outside the cabinet 10. In a case where the machine room is located inside the cabinet 10, the machine room may be partitioned from the receiving space S. A plurality of devices including a steam generator (not illustrated) may be disposed in the inner portion of the machine room.

The steam generator may include a predetermined housing for storing water or passing water and a heater for heating the water in the housing. Accordingly, the steam generator can supply steam to the steamer 30 to be described later by heating water by the heater.

The clothing processing apparatus according to the present embodiment may include a holder 60 on which the clothing supporter 20 is held and a tilting motor 70 for rotating the holder 60.

The holder 60 may be located in the receiving space S. The holder 60 may be supported by being fastened to or suspended from the upper portion of the cabinet 10. The holder 60 may be formed long in a front and rear direction.

The holder 60 may be rotated about a virtual rotation axis formed long in the front and rear directions. In more detail, at least one of both ends of the holder 60 may be connected to the tilting motor 70, and the holder 60 may be rotated by the rotational force of the tilting motor 70.

At least one tilting motor 70 may be provided. For example, as illustrated in FIG. 3, two tilting motors 70 may be provided, and each tilting motor 70 may be respectively connected to both ends of the holder 60.

The tilting motor 70 may rotate by a predetermined angle in one direction or the other direction to rotate the holder 60. It is obvious that the rotation angle of the holder 60 may be preset or may be changed by a user's manipulation.

At least a portion of the cross-section of the holder 60 may have an angular shape. In other words, the holder 60 may not have a circular bar shape. As an example, the holder 60 may be a square bar. Accordingly, the ring 22 of the clothing supporter 20, which will be described later, may be tilted.

The clothing supporter 20 may be held on the holder 60. The clothing supporter 20 may support the clothing C. The clothing supporter 20 may be referred to as a clothing hanger.

In more detail, the clothing supporter 20 may include a hanging part 21 on which clothing is hung, a ring 22 for suspending the hanging part 21 on the holder 60, and a side frame 23 extending downward from the hanging part 21.

The hanging part 21 may be disposed long in the left and right direction. The upper end of the hanging part 21 may be inclined in a direction in which the height decreases as the distance from the ring 22 increases. Clothing may be hung and supported on the upper end of the hanging part 21.

The ring 22 may be provided at the top center of the hanging part 21. The ring 22 may be hung on the holder 60. The holder 60 may be provided with a groove part 61 that prevents the ring 22 from sliding in the front and rear direction. The groove part 61 may be formed on the upper surface of the holder 60. The ring 22 may be fitted into the groove part 61 to be suspended on the holder 60, and the groove part 61 may constrain the ring 22 in the front and rear direction.

At least a portion of the ring 22 may be angled to correspond to the cross-sectional shape of the holder 60. Accordingly, when the holder 60 is rotated, the ring 22 may be tilted without sliding with respect to the holder 60. In other words, the entire clothing supporter 20 may be tilted.

The side frame 23 may support the body C1 of the clothing C from the inner portion thereof.

A pair of side frames 23 may be provided. A pair of side frames 23 may extend downward from both end portions of the hanging part 20, respectively. The pair of side frames 23 may be spaced apart from each other in the left and right direction.

The clothing supporter 20 may further include a connection bar 24 connecting the lower ends of the pair of side frames 23 to each other. Accordingly, the side frame 23 may be firmly fixed without being bent.

When the clothing C is supported by the clothing supporter 20, the pair of side frames 23 may support both sides of the body C1 of the clothing C from the inside. Accordingly, the body C1 may be kept taut in the left and right direction. On the other hand, both arms C2 and C3 of the clothing C may droop downward due to their own weight.

Meanwhile, the clothing processing apparatus may include a steamer 30 to which steam is sprayed and an elevating motor 40 for elevating the steamer 30 in the vertical direction. The clothing processing apparatus may further include a rotation motor 50 for rotating the steamer 30.

The steamer 30 may be formed to be long in the left and right direction. The steamer 30 may be located in the receiving space S of the cabinet 10. The steamer 30 may be movable in the vertical direction and may be constrained in the front and rear direction and the left and right direction.

The steamer 30 may refresh the clothing C by spraying steam toward the clothing C supported by the clothing supporter 20. In more detail, the steamer 30 can elevate in the vertical direction to spray steam to the clothing C, so that the wrinkles of the clothing C can be effectively spread.

The steamer 30 may be elevated in the vertical direction by the elevating motor 40. The configuration for converting the rotational force of the elevating motor 40 into vertical power is not limited. As an example, the elevating motor 40 may rotate the lead screw 42 which is disposed long in the vertical direction, and a screw hole to which the lead screw 42 is fastened may be formed on the rotation motor bracket 51 to be described later. In this case, when the elevating motor 40 rotates the lead screw 42, the steamer 30, the rotation motor 50, the rotation motor bracket 51, and the guide bracket 52 may elevate together.

The elevating motor 40 may be disposed on inner surfaces of the cabinet 10 in the left and right direction. The elevating motor 40 may be connected to at least one of both ends of the lead screw 42. For example, the elevating motor 40 may be connected to the lower end of the lead screw 42. In this case, guide bars 41 for guiding the elevation of the steamer 30 may be provided on the inner surfaces of the cabinet 10 in the left and right direction, respectively. The guide bar 41 may be disposed long in the vertical direction.

However, the present disclosure is not limited thereto, and of course, a configuration in which a rack gear formed long in the vertical direction on the inner surface of the cabinet 10 is provided and a pinion gear meshed with the rack gear is connected to the elevating motor 40 is also possible. In this case, the elevating motor 40 may be elevated together with the steamer 30.

Meanwhile, the steamer 30 includes a pair of steam bodies 31 spaced apart from each other in the front and rear direction, a connection part 32 connecting the end portions of the pair of steam bodies 31 to each other, and the connection part 33 extending outward from the connection part 32.

Each steam body 31 may be in a shape of a bar formed long in the left and right direction.

A pair of steam bodies 31 may be spaced apart from each other in the front and rear direction to face each other. The clothing C caught by the clothing supporter 20 may move between the pair of steam bodies 31.

The pair of steam bodies 31 may include a front steam body 31A and a rear steam body 31B. The clothing C held on the clothing supporter 20 may move between the front steam body 31A and the rear steam body 31B.

The front steam body 31A may spray steam toward the front of the clothing C held on the clothing supporter 20, and the rear steam body 31B may spray steam toward the back surface of the clothing C held on the clothing supporter 20.

A plurality of steam spraying parts 31C facing the clothing C may be formed in each steam body 31. The steam spraying part 31C may be configured as a hole or a nozzle.

In more detail, a plurality of steam spraying parts 31C may be formed on the rear surface of the front steam body 31A. In addition, a plurality of steam spraying parts 31C may be formed on the front surface of the rear steam body 31B.

The connection part 32 may connect the end portion of the front steam body 31A and the end portion of the rear steam body 31B. In other words, the left end portion of the front steam body 31A and the left end portion of the rear steam body 31B may be connected to each other by the connection part 32. In addition, the right end of the front steam body 31A and the right end of the rear steam body 31B may be connected to each other by the connection part 32.

In other words, the front steam body 31A, the rear steam body 31B, and the pair of connection parts 32 may form a single closed curve through which the clothing hung on the clothing supporter 20 passes. Thereby, the clothing may not deviate from the steamer 30 with respect to the horizontal direction.

The extension part 33 may extend from the connection part 32 toward the inner surface of the cabinet 10. In more detail, any one of the extension parts 33 may extend to the left from the connection part 32 connecting the left end portions of each of the front steam body 31A and the rear steam body 31B. The other extension part 33 may extend to the right from the connection part 32 connecting the right end portions of each of the front steam body 31A and the rear steam body 31B.

In other words, the steamer 30 may include a pair of connection parts 32 and a pair of extension parts 33.

At least one of the pair of extension parts 33 may be connected to the rotation motor 50. For example, the rotation motor 50 may be connected to one of the pair of extension parts 33, and the guide bracket 52 may be connected to the other thereof. In other words, one of both end portions of the steamer 30 may be connected to the rotation motor 50, and the other thereof may be rotatably connected to the guide bracket 52. However, the present disclosure is not limited thereto, and, of course, a configuration in which both end portions of the steamer 30 are respectively connected to the rotation motor 50 is also possible.

Accordingly, the steamer 30 can be rotated by the rotation motor 50 to contact the clothing, and in this state, the steamer 30 can spray steam while elevating to effectively spread wrinkles or folds of the clothing C. In addition, the steamer may spray steam on the clothing C at various angles.

A rotation motor bracket 51 on which the rotation motor 50 is mounted may be fastened to the steamer 30, more specifically, the extension part 33.

A guide groove into which the guide bar 41 is fitted may be provided in the rotation motor bracket 51 and the guide bracket 52. Accordingly, the steamer 30, the guide bracket 52, the rotation motor bracket 51, and the rotation motor 50 may be guided in elevation by the guide bar 41.

In addition, a steam injector 33A may be formed in the steamer 30. In more detail, the steam injector 33A may be formed in the connection part 33. A steam hose (not illustrated) connected to the steam generator (not illustrated) may be connected to the steam injector 33A. Accordingly, the steam generated by the steam generator may flow into the steamer 30.

An inner steam flow path for guiding the steam injected to the steam injector 33A to the steam spraying part 31C may be formed inside the steamer 30. The inner steam flow path may be formed over the extension part 33, the connection part 32, and the inner portion of the steam body 31. Accordingly, steam may be sprayed toward the clothing C from the steam spraying part 31C.

Meanwhile, in a case where the clothing C (see FIG. 7A) are hung on the clothing supporter 20 held on the holder 60, since the arms C2 and C3 of the clothing C droop downward, an overlapping portion is inevitably formed between the body C1 and the arms C2 and C3, and wrinkles occur. In this state, in a case where the steamer 30 elevates and sprays steam to refresh the clothing C, there is a risk that the wrinkles cannot be removed and wrinkles may become worse. In order to solve this risk, the wrinkles between the arms C2 and C3 and the body C1 can be effectively removed by refreshing the clothing C in a state where the clothing C is tilted by a predetermined angle.

Figure 5:
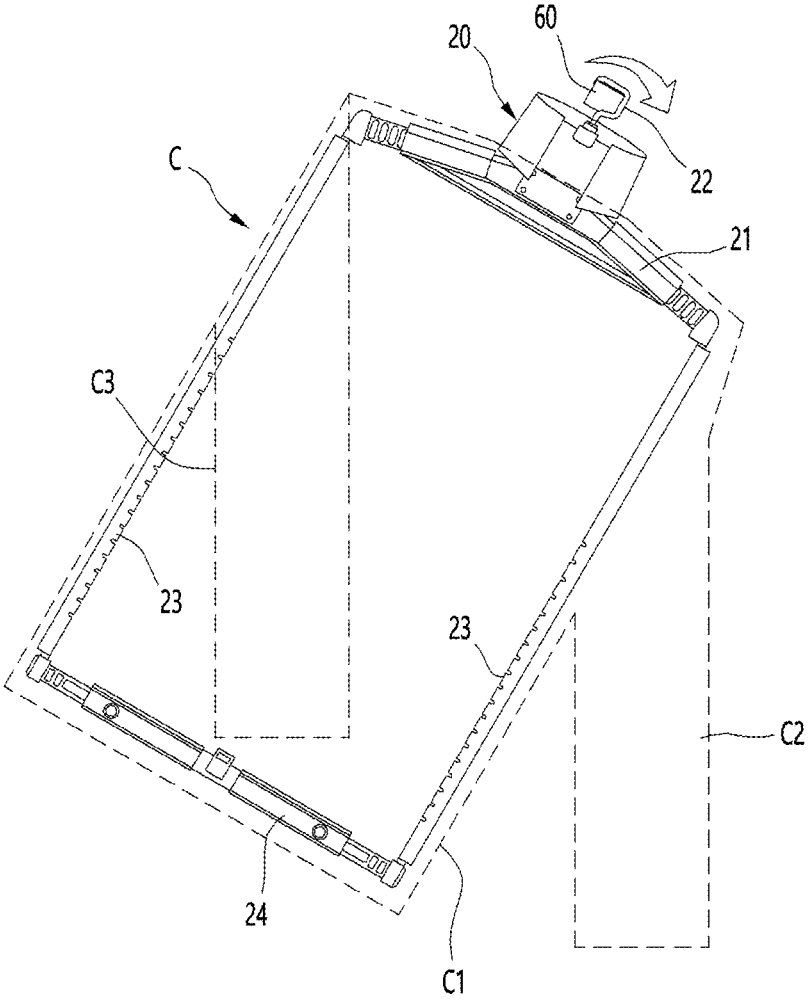
FIG. 5 is a view for explaining the rotation of the holder for refreshing one arm of the clothing.
Figure 6:
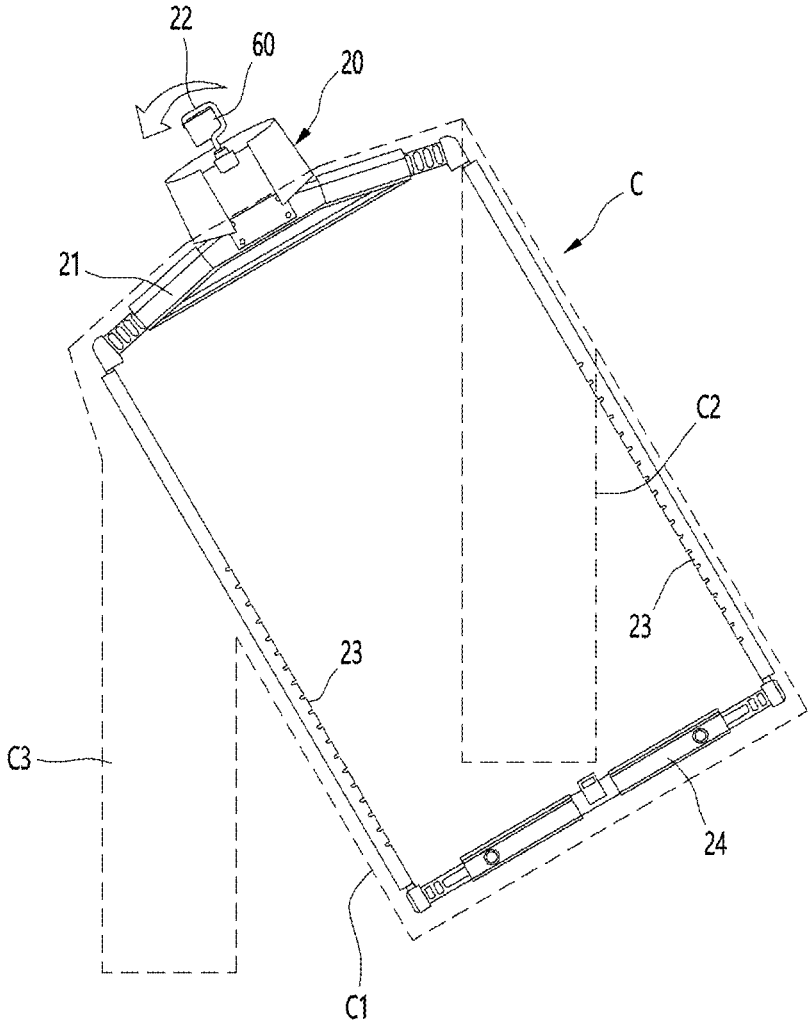
FIG. 6 is a view for explaining the rotation of the holder for refreshing the other arm of the clothing.

FIG. 5 is a view for explaining the rotation of the holder for refreshing one arm of the clothing, and FIG. 6 is a view for explaining the rotation of the holder for refreshing the other arm of the clothing.

As described above, the holder 60 may be rotated by the tilting motor 70 (refer to FIG. 3), and the clothing supporter 20 may be tilted. Accordingly, the clothing C hung on the clothing supporter 20 may also be tilted.

As illustrated in FIG. 5, in a case where the clothing supporter 20 is tilted by a predetermined angle in one direction, one arm C2 of both arms of the clothing C is separated from the body C1 and droops downward. This means that one arm C2 of both arms of the clothing C has a minimized overlapping portion with the body C1 and droops downward. At this time, the body C1 of the clothing C may be supported from the inside by the side frame 23 of the clothing supporter 20 and thus may not droop downward.

In this state, when the steamer 30 elevates and sprays steam, the one arm C2 can be effectively refreshed without wrinkles.

As illustrated in FIG. 6, in a case where the clothing supporter 20 is tilted by a predetermined angle in the other direction, the other arm C3 of both arms of the clothing C is separated from the body C1 and droops downward. This means that the overlapping portion of the other arm C3 among both arms of the clothing C with the body C1 is minimized and droops downward. At this time, the body C1 of the clothing C may be supported from the inside by the side frame 23 of the clothing supporter 20 and thus may not droop downward.

In this state, when the steamer 30 elevates and sprays steam, the other arm C3 can be effectively refreshed without wrinkles.

Figure 7:
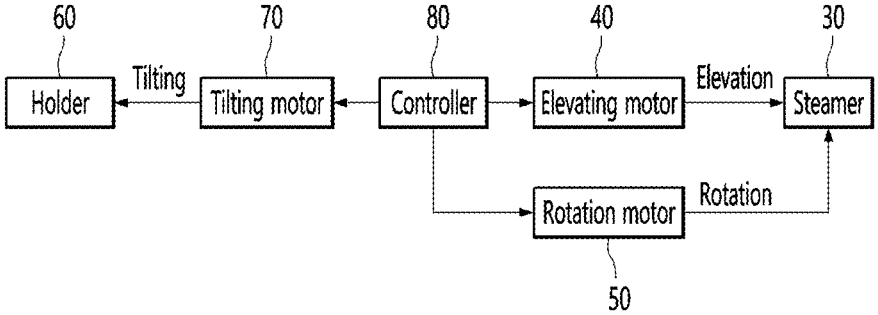
FIG. 7 is a control block diagram illustrating a clothing processing apparatus according to a first embodiment of the present disclosure.

FIG. 7 is a control block diagram illustrating a clothing processing apparatus according to a first embodiment of the present disclosure.

The clothing processing apparatus according to the present embodiment may include a controller 80. The controller 80 may control the elevating motor 40, the rotation motor 50, and the tilting motor 70 described above.

The controller 80 may control the elevating motor 40 to elevate the steamer 30. Also, the controller 80 may control the rotation motor 50 to rotate the steamer 30. The controller 80 may simultaneously control the elevating motor 40 and the rotation motor 50 to combine elevating and rotating operations of the steamer 30 to spray steam onto the clothing C in various ways.

The controller 80 may control the tilting motor 70 to tilt the clothing supporter 20. The controller 80 may tilt the clothing supporter 20 so that the arms C2 and C3 of the clothing C droop downward.

Figure 8:
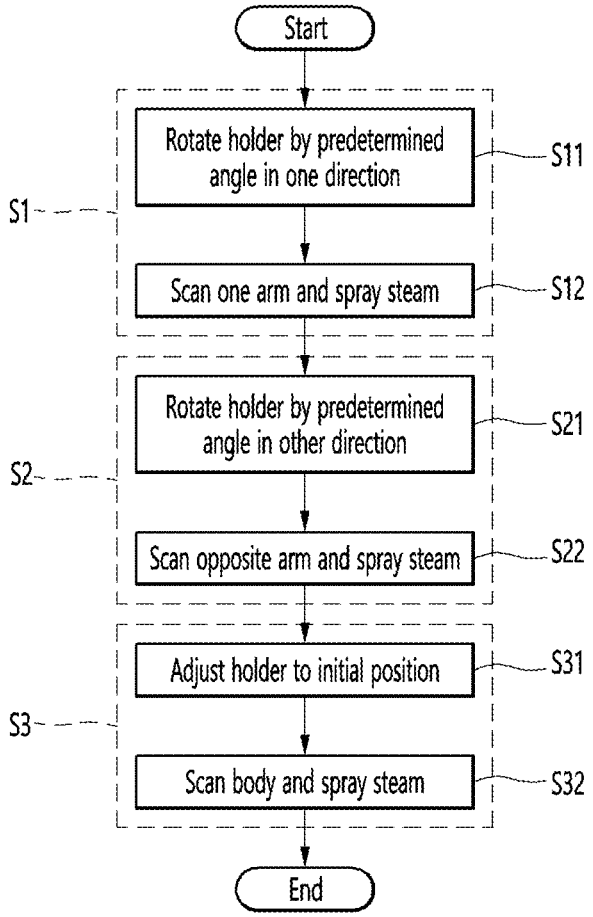
FIG. 8 is a flowchart illustrating an example of a method for controlling a clothing processing apparatus according to the first embodiment of the present disclosure.

FIG. 8 is a flowchart illustrating an example of a method for controlling a clothing processing apparatus according to the first embodiment of the present disclosure.

Hereinafter, a method for controlling the clothing processing apparatus according to the present embodiment will be described. The following control method may be performed in a state where the clothing supporter 20 on which the clothing C is hung is held on the holder 60.

The method for controlling a clothing processing apparatus according to the present embodiment may include a first arm refreshing step S1, a second arm refreshing step S2, and a body refreshing step S3.

The order of performing the first arm refreshing step S1, the second arm refreshing step S2, and the body refreshing step S3 may be changed as necessary. Also, the first arm refreshing step S1, the second arm refreshing step S2, and the body refreshing step S3 may be repeatedly performed as needed.

Hereinafter, a case where the first arm refreshing step S1, the second arm refreshing step S2, and the body refreshing step S3 are sequentially performed will be described as an example.

The first arm refreshing step S1 may include a first arm alignment step S11 and a first arm scanning step S12.

In the first arm alignment step S11, the controller 80 may control the tilting motor 70 to rotate the holder 60 in one direction by a predetermined angle. In this case, one arm C2 of the clothing C may be separated from the body C1 and droop downward.

The first arm scanning step S12 may be performed after the first arm alignment step S11. In the first arm scanning step S12, the controller 80 may control the elevating motor 40 to elevate the steamer 30 and may spray steam from the steamer 30. Accordingly, the steamer 30 may refresh the one arm C2 that droops downward while scanning.

The second arm refreshing step S2 may include a second arm alignment step S21 and a second arm scanning step S22.

In the second arm alignment step S21, the controller 80 may control the tilting motor 70 to rotate the holder 60 in the other direction by a predetermined angle. In this case, the other arm C3 of the clothing C may be separated from the body C1 and may droop downward.

The second arm scanning step S22 may be performed after the second arm alignment step S21. In the second arm scanning step S22, the controller 80 may control the elevating motor 40 to elevate the steamer 30 and may spray steam from the steamer 30. Accordingly, the steamer 30 may refresh while scanning the other arm C3 drooping downward.

The body refreshing step S3 may include a body alignment step S31 and a body scanning step S32. However, in a case where the body refreshing step S3 is performed before the first arm refreshing step S1 and the second arm refreshing step S2, the body aligning step S31 may be omitted.

In the body alignment step S31, the controller 80 may control the tilting motor 70 to adjust the holder 60 to the initial position. In other words, the controller 80 may control the holder 60 to an initial position in which the holder does not rotate.

The body scanning step S32 may be performed after the body alignment step S31. In the body scanning step S32, the controller 80 may control the elevating motor 40 to elevate the steamer 30 and may spray steam from the steamer 30. Accordingly, the steamer 30 may scan and refresh the body C1 spreading taut by the side frame 23 of the clothing supporter 20.

Accordingly, wrinkles of the clothing C are minimized, and refreshing of the clothing C can be performed.

Figure 9:
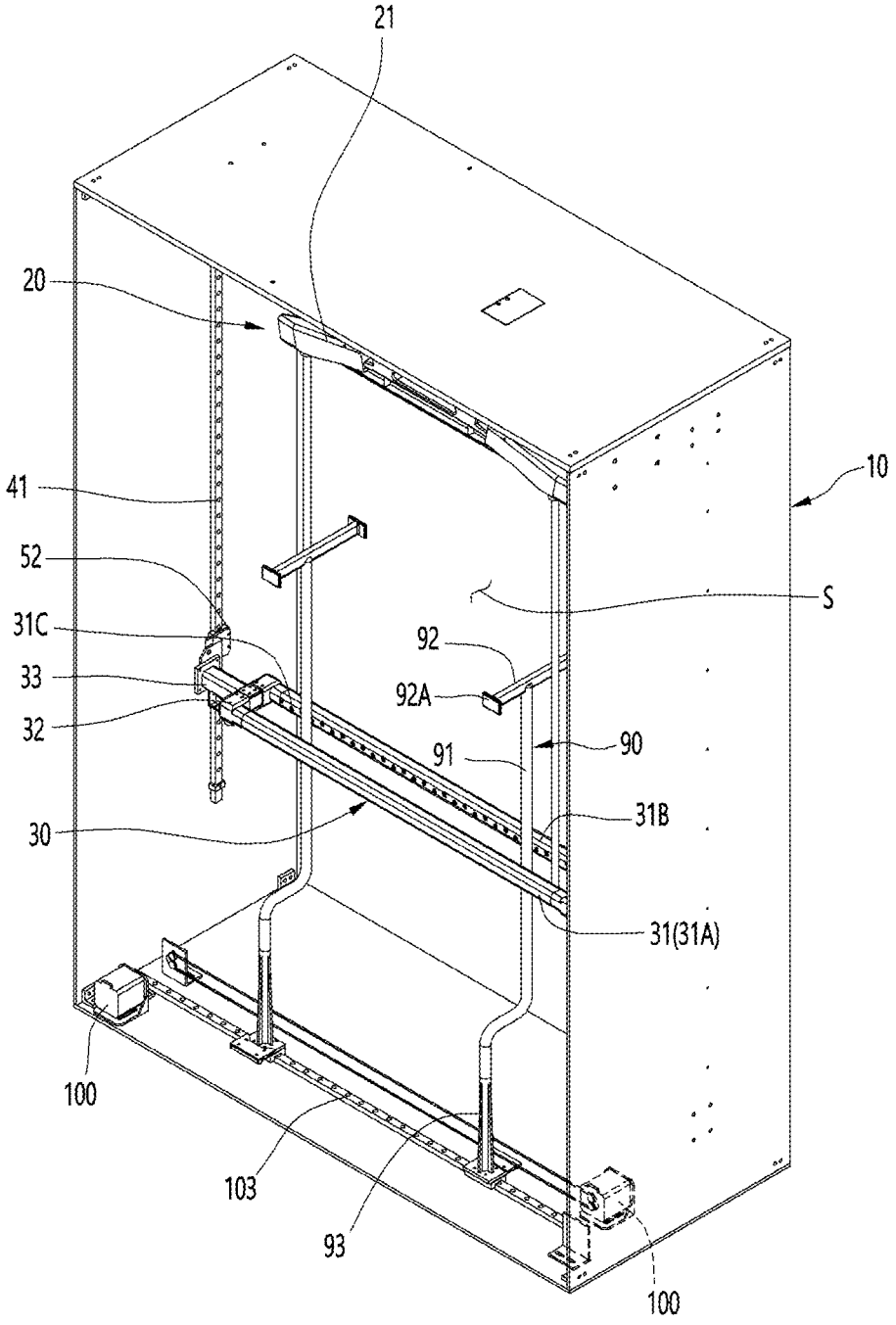
FIG. 9 is a view for explaining the configuration of a clothing processing apparatus according to a second embodiment of the present disclosure.
Figure 10:
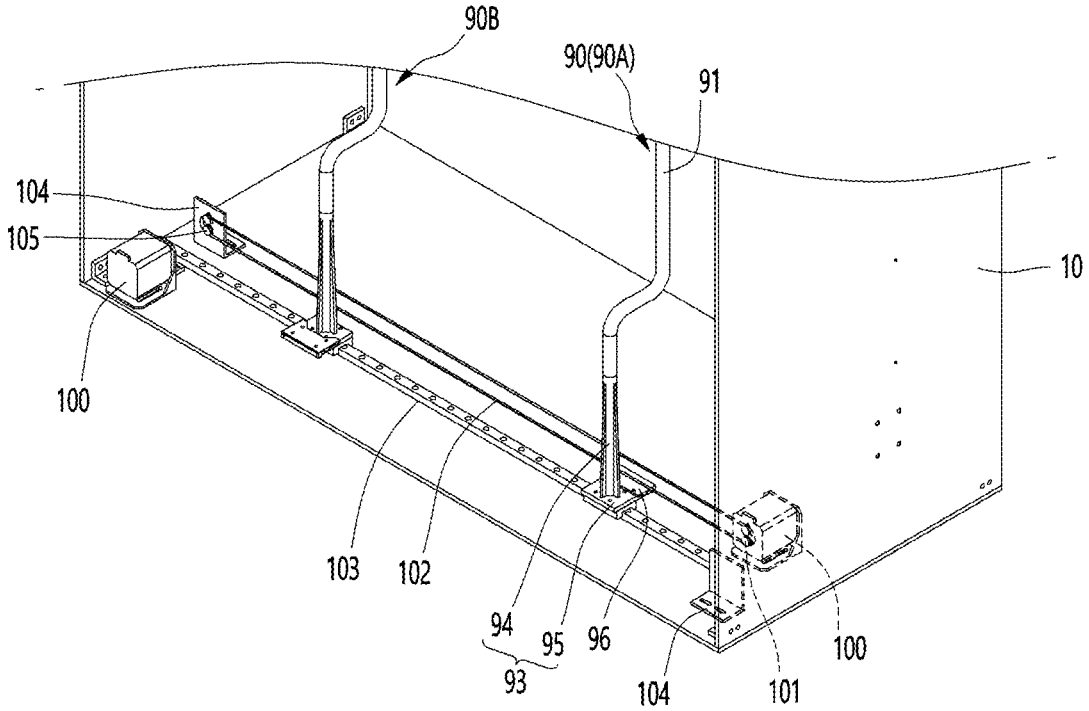
FIG. 10 is an enlarged view illustrating a lower portion of the clothing processing apparatus illustrated in FIG. 9.

FIG. 9 is a view for explaining the configuration of a clothing processing apparatus according to a second embodiment of the present disclosure, and FIG. 10 is an enlarged view illustrating a lower portion of the clothing processing apparatus illustrated in FIG. 9.

Hereinafter, contents that overlap with those described in the first embodiment above will be omitted and the differences therebetween will be mainly described.

The clothing processing apparatus according to the present embodiment may include a separator 90 that separates the body C1 and arms C2 and C3 of the clothing C, and a moving motor 100 that moves the separator 90 in the left and right direction.

The separator 90 may move in the left and right direction and move between the body C1 and the arms C2 and C3 of the clothing C to separate the body C1 and the arms C2 and C3. Accordingly, the clothing processing apparatus according to the present embodiment has an advantage that the holder 60 does not need to rotate.

In addition, since the holder 60 does not rotate, it is possible to use the clothing supporter 20 that includes the hanging part 21 and the ring 22 and does not include the side frame 23 (see FIG. 4). In other words, there is an advantage of being capable of using a general clothing hanger that is commonly available in the market.

A pair of separators 90 may be provided. In other words, the pair of separators 90 may include a first separator 90A and a second separator 90B.

The first separator 90A separates the body C1 of the clothing C and one arm C2, and the second separator 90B may separate the body C1 of the clothing C and the other arm C3.

The first separator 90A and the second separator 90B can each independently move in the left and right direction.

The separator 90 may include a moving bar 91 that is formed long in the vertical direction, and a separate part 92 that is formed long in the front and rear direction at the upper end of the moving bar 91. The separator 90 may further include a moving body 93 to which a lower end of the moving bar 91 is fastened and which is moved by the moving motor 100.

The moving bar 91 may be formed long in the vertical direction. The moving bar 91 may be formed by a combination of a straight part and a curved part. Accordingly, the moving bar 91 can move in the left and right direction while avoiding interference with other components disposed in the inner space of the cabinet 10.

The moving bar 91 may pass between the front steam body 31A and the rear steam body 31B of the steamer 30. Accordingly, the separator 90 can move in the left and right direction without interfering with the steamer 30.

A separate part 92 may be formed at the upper end of the moving bar 91. The separate part 92 may be formed long from the upper end of the moving bar 91 in the front and rear direction. The separate part 92 may include extension parts 92A formed at both ends.

The lower end of the moving bar 91 is fastened to the moving body 93 to move together with the moving body 93. The moving body 93 may move along the guide rail 103 in the left and right direction by the moving motor 100.

In more detail, the moving body 93 may include a main body 94 to which the moving bar 91 is fastened, and a guide block 95 moving along the separator guide rail 103.

The main body 94 may have a tubular shape formed long in the vertical direction. The lower end of the moving bar 91 may be inserted into the main body 94 to be fitted thereinto. A plurality of ribs for reinforcing rigidity may be formed on the outer circumference of the main body 94. The plurality of ribs may be connected to the guide block 95.

A main body 94 may be coupled to the guide block 95. The guide block 95 may be integrally formed with the main body 94 but is not limited thereto.

A guide groove into which the guide rail 103 is fitted may be formed on the bottom surface of the guide block 95. Accordingly, the guide block 95 may be guided to move along the guide rail 103 in the left and right direction.

The separator 90, more specifically, the moving body 93 may be provided with a belt holder 96 to which the power of the moving motor 100 is transmitted. The belt holder 96 can hold the belt 103.

The belt holder 96 may be fastened to the guide block 95 at the front or rear of the guide block 95. The belt holder 96 can be moved by the power of the belt 102 rotating by the moving motor 100. Thereby, the entire separator 90 can move smoothly in the left and right direction.

The moving motor 100 may be provided on an inner bottom surface of the cabinet 10. A pair of moving motors 100 may be provided. One of the pair of moving motors 100 may move the first separator 90A, and the other moving motor may move the second separator 90B.

The pair of moving motors 100 may be located opposite to each other with respect to the guide rail 103. Accordingly, the belt 102 connected to each moving motor 100 can rotate smoothly without interfering with each other.

For example, the moving motor 100 for moving the first separator 90A is located behind the guide rail 103, and the moving motor 100 for moving the second separator 90B can be located in front of the guide rail 103.

In this case, the belt holder 96 of the first separator 90A is fastened from the rear of the guide block 95 of the first separator 90A, and the belt holder 96 of the second separator 90B may be fastened in front of the guide block 95 of the second separator 90B.

The power of the moving motor 100 may be transmitted to the separator 90 through the belt 102. In more detail, one side of the belt 102 forming a closed curve is in contact with the rotary pulley 101 connected to the moving motor 100, and the other side of the belt may be in contact with the support pulley 105 installed in the pulley bracket 104. When the rotary pulley 101 rotates, the belt 102 may rotate by the frictional force between the rotary pulley 101 and the belt 102. In this case, the support pulley 105 may support the belt 102 while rotating by frictional force with the belt 102.

The belt holder 96 of the separator 90 may be connected to the belt 102. Accordingly, the separator 90 can move in the left and right direction according to the rotation of the belt 102.

However, the present disclosure is not limited thereto, and of course, a configuration in which a rotation gear is connected to the rotation motor 100, a chain is connected to the rotation gear, and a belt holder 96 of the separator 90 is connected to the chain is also possible.

The guide rail 103 may be provided on an inner bottom surface of the cabinet 10. The guide rails 103 may be disposed long in the left and right direction. The guide rail 103 may be fitted into the guide groove formed in the guide block 95 to guide the movement of the separator 90 in the left and right direction.

The pulley bracket 104 may be provided on an inner bottom surface of the cabinet 10. A pair of pulley brackets 104 may be also provided similarly to the moving motor 100. The pair of separator pulley brackets 104 may be located opposite to each other with respect to the guide rail 103.

The pulley bracket 104 connected to one of the moving motors 100 and the belt 102 may face the other moving motor 100 in the front and rear direction. Accordingly, the movement range of the separator 90 in the left and right direction can be secured to the maximum for the limited length of the belt 102.

Figure 11:
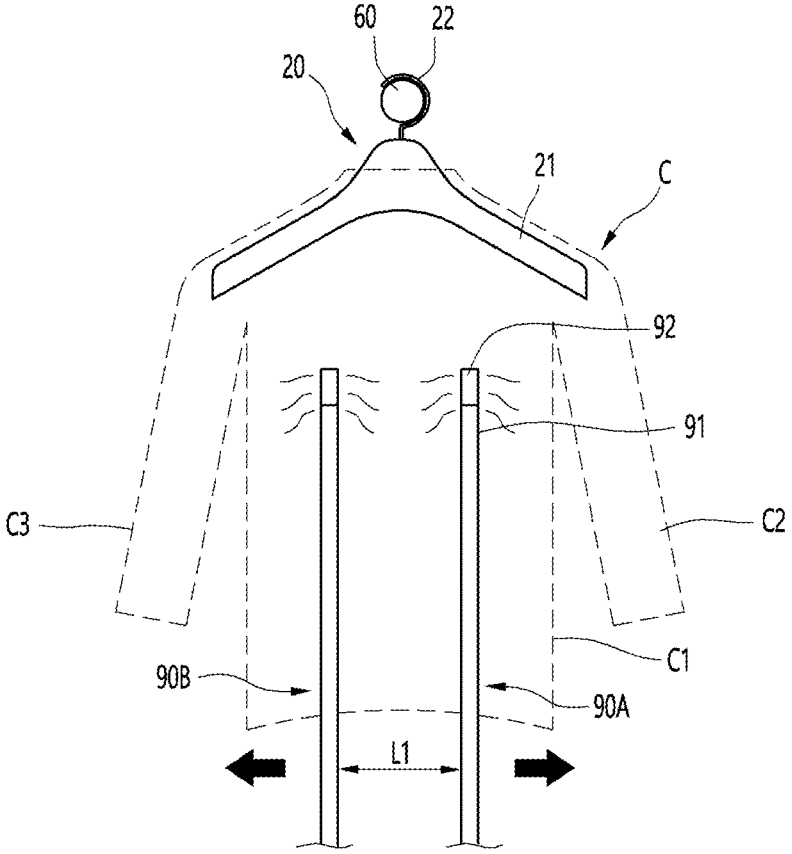
FIG. 11 is a view illustrating a clothing supporter and a separator held on a holder according to a second embodiment of the present disclosure.

FIG. 11 is a view illustrating a clothing supporter and a separator held on a holder according to a second embodiment of the present disclosure.

FIG. 11 illustrates the initial position of the separator 90. The left-right distance L1 between the pair of separators 90 in the initial position state may be shorter than the left-right width of the body C1 of the clothing C. Therefore, when the clothing supporter 20 is mounted on the holder 60, the body C1 of the clothing C caught on the clothing supporter 20 is separated by the separate parts 92 of each of the pair of separators 90. may be in contact. In this case, the separator 90 may be located at the front or rear of the body C1 of the clothing C.

Figure 12:
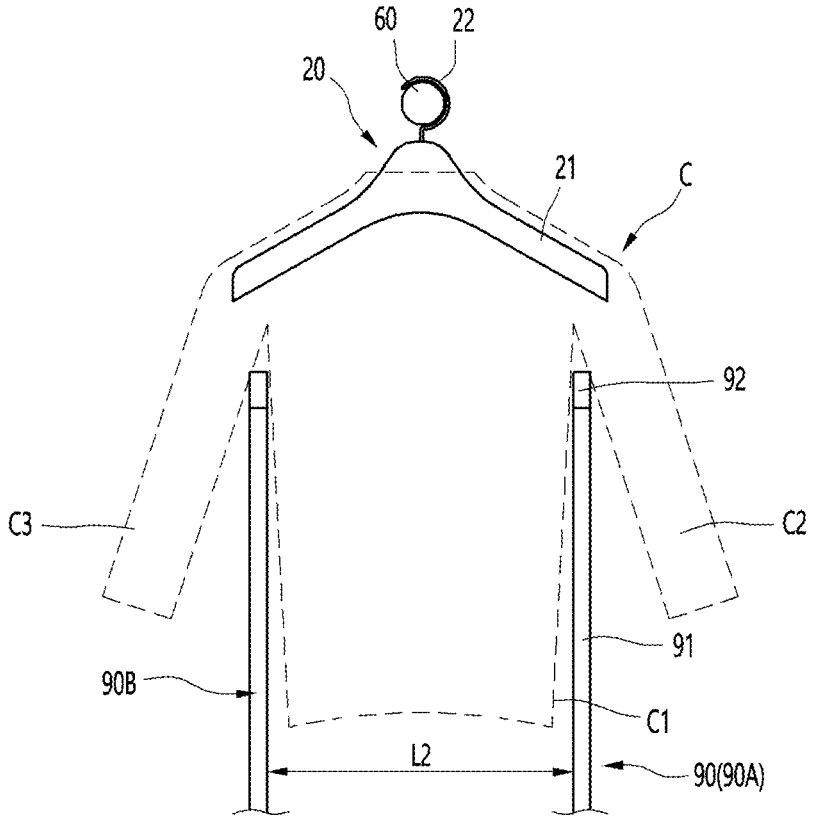
FIG. 12 is a view illustrating a state where the separator illustrated in FIG. 11 is moved between the body and the arm of the clothing.

FIG. 12 is a view illustrating a state in which the separator illustrated in FIG. 11 is moved between the body and the arm of the clothing.

FIG. 12 illustrates a state where the separator 90 is moved between the body and the arm of the clothing. In this state, the distance L2 between the pair of separators 90 in the left and right direction may be greater than the distance L1 between the pair of separators 90 in the left and right direction, which are in the initial position. In other words, the pair of separators 90 may move away from each other from the initial position and move between the body C1 and the arms C2 and C3 of the clothing C.

In more detail, the pair of separators 90 at their initial positions may move in a direction away from each other in a state of being in contact with the body C1 of the clothing C, and when the separate part 92 of the separator 90 reaches between the body C1 and the arms C2 and C3, the separate part 92 may naturally move between the body C1 and the arms C2 and C3 due to the sagging of the clothing C.

In more detail, the first separator 90A may be moved between the body C1 and one of the arms C2 of the clothing C, and the second separator 90B may be moved between the body C1 and the other of the arms C3 of the clothing C.

Since the separate part 92 of the separator 90 is formed long in the front and rear direction, the separate part 92 can reliably separate the body C1 and the arms C2 and C3 of the clothing C.

The pair of separators 90 may be configured to stop moving as soon as the pair of separators 90 move between the body C1 and the arms C2 and C3 of the clothing C. Alternatively, the pair of separators 90 may move further apart by a predetermined distance even after the pair of separators 90 move between the body C1 and the arms C2 and C3 of the clothing C.

Figure 13:
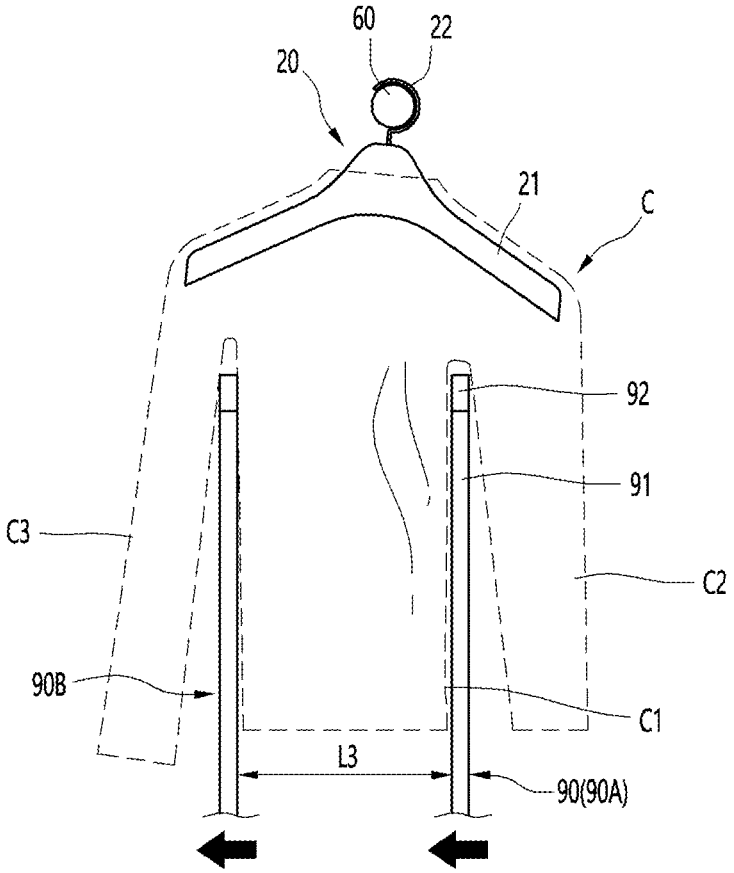
FIG. 13 is a view for explaining the operation of a separator for refreshing one arm of clothing.

FIG. 13 is a view for explaining the operation of a separator for refreshing one arm of clothing.

As illustrated in FIG. 13, the separator 90 may move in one direction to separate one arm C2 of the clothing C from the body C1 and droop one arm downward.

In more detail, the first separator 90A and the second separator 90B may each move in one direction by a predetermined distance. In this case, the first separator 90A may move more than the second separator 90B. Accordingly, the distance L3 between the first separator 90A and the second separator 90B in the left and right direction in a state where one arm C2 of the clothing C is drooping downward may be closer than the distance L2 between the first separator 90A and the second separator 90B in the left and right direction immediately after moving between the arm C2 and C3 and the body C1 of the clothing C.

Unlike the first embodiment described above, the holder 60 of the clothing processing apparatus according to the present embodiment may be configured as a circular bar. Accordingly, by the mechanical force applied to the clothing C by the separator 90, the ring 22 of the clothing supporter 20 slides with respect to the holder 60, and the clothing supporter 20 and the clothing C can be tilted. As a result, one arm C2 of the clothing C may be separated from the body C1 and droop downward.

However, the present disclosure is not limited thereto, and only the first separator 90A moves in one direction and the second separator 90B does not move, and thus it is also possible to separate one arm C2 from the body C1 of the clothing C and droop the arm downward.

In a state where one arm C2 of the clothing C is separated from the body C1 and droops downward, when the steamer 30 elevates and sprays steam, the one arm C2 can be effectively refreshed without wrinkles.

Figure 14:
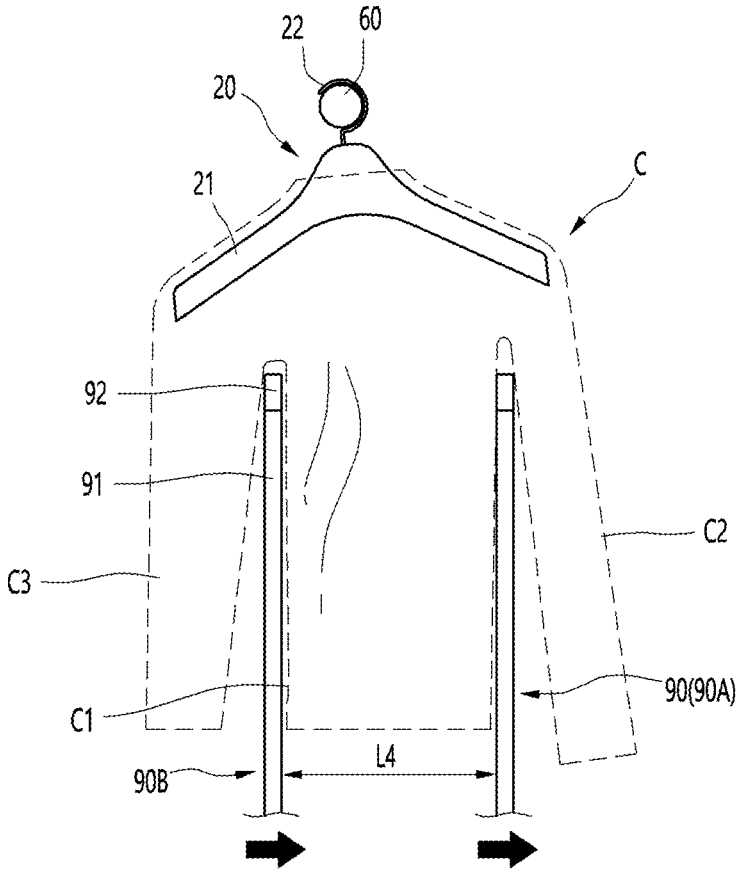
FIG. 14 is a view for explaining the operation of the separator for refreshing another arm of clothing.

FIG. 14 is a view for explaining the operation of the separator for refreshing another arm of clothing.

As illustrated in FIG. 14, the separator 90 may move in the other direction to separate the other arm C3 of the clothing C from the body C1 and droop it downward.

In more detail, the first separator 90A and the second separator 90B may each move in the other direction by a predetermined distance. In this case, the second separator 90B may move more than the first separator 90A. Accordingly, the distance L4 between the first separator 90A and the second separator 90B in the left and right direction in a state where the other arm C3 of the clothing C droops downward may be closer than the distance L2 between the first separator 90A and the second separator 90B in the left and right direction immediately after moving between the arm C2 and C3 and the body C1 of the clothing C.

By the mechanical force applied to the clothing C by the separator 90, the ring 22 of the clothing supporter 20 slides with respect to the holder 60, and the clothing supporter 20 and the clothing C can be tilted. Accordingly, the other arm C3 of the clothing C may be separated from the body C1 and may droop downward.

However, the present disclosure is not limited thereto, and only the second separator 90B moves in the other direction and the first separator 90A does not move, and thus it is also possible to separate the other arm C3 of the clothing C from the body C1 and droop the arm downward.

When the steamer 30 elevates and sprays steam in a state where the other arm C3 of the clothing C is separated from the body C1 and droops downward, the other arm C3 may be effectively refreshed without wrinkles.

Figure 15:
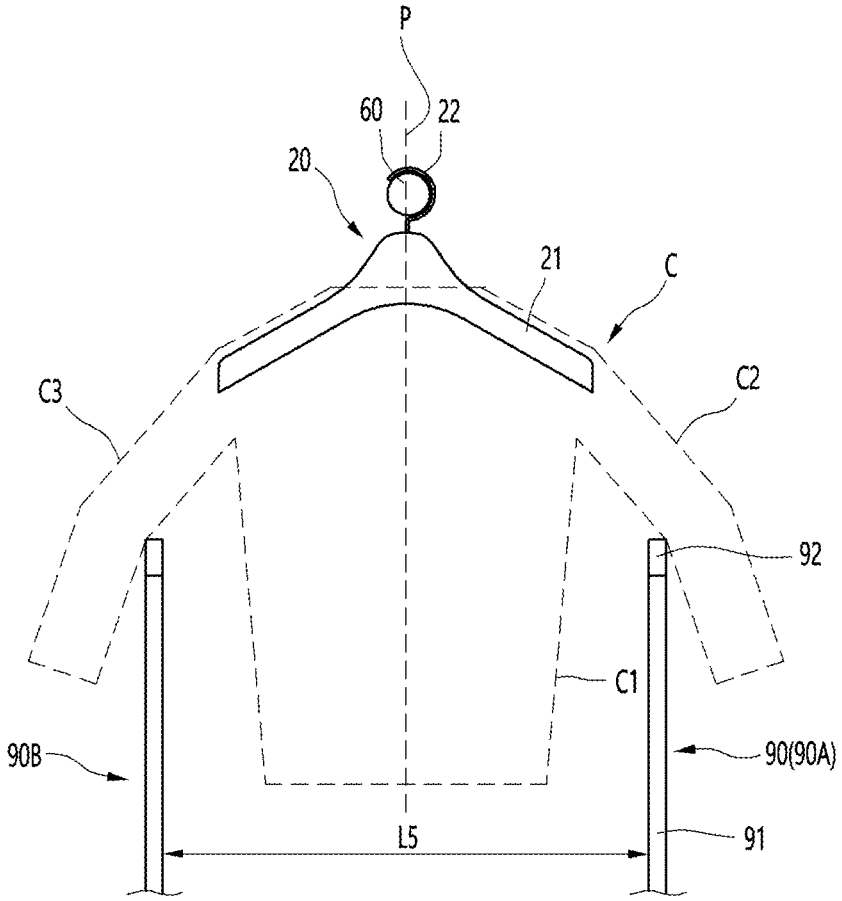
FIG. 15 is a view for explaining the operation of the separator for refreshing the body of clothing.

FIG. 15 is a view for explaining the operation of the separator for refreshing the body of clothing.

As illustrated in FIG. 15, The pair of separators 90 may move in a direction away from each other to separate the arms C2 and C3 from the body of the clothing C.

In more detail, the first separator 90A and the second separator 90B may move in a direction away from each other. The first separator 90A and the second separator 90B may move in opposite directions by the same distance from each other with respect to a virtual vertical plane P passing through the holder 60. Accordingly, the clothing supporter 20 and the clothing C are not tilted, and the body C1 of the clothing C may droop downward.

Accordingly, in a state where both arms C2 and C3 of the clothing C are separated from the body C1, the distance L5 between the first separator 90A and the second separator 90B in the left and right direction may be greater than the distance L2 between the first separator 90A and the second separator 90B in the left and right direction immediately after moving between the body C1 and the arms C2 and C3 of the clothing C.

When the steamer 30 elevates and sprays steam in a state where both arms C2 and C3 of the clothing C are separated from the body C1, the body C1 may be effectively refreshed without wrinkles.

Figure 16:
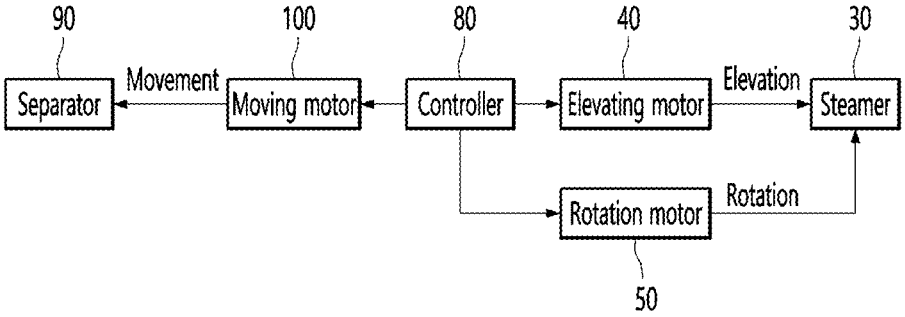
FIG. 16 is a control block diagram illustrating a clothing processing apparatus according to a second embodiment of the present disclosure.

FIG. 16 is a control block diagram illustrating a clothing processing apparatus according to a second embodiment of the present disclosure.

The controller 80 of the clothing processing apparatus according to the present embodiment may control the moving motor 100 in addition to the elevating motor 40 and the rotation motor 50.

The controller 80 may control the moving motor 100 to move the separator 90 in the left and right direction.

In more detail, the controller 80 may move the first separator 90A and the second separator 90B in a direction away from each other from the initial position, and the first separator 90A and the second separator 90B may move between the body C1 and arms C2 and C3 of the clothing C.

Thereafter, the controller 80 separates one arm C2 of the clothing C from the body C1 by moving at least one of the first separator 90A and the second separator 90B in one direction to droop downward.

Alternatively, the controller 80 separates the other arm C3 of the clothing C from the body C1 by moving at least one of the first separator 90A and the second separator 90B in the other direction to droop downward.

Alternatively, the controller 80 may separate the arms C2 and C3 of the clothing C from the body C1 by moving the first separator 90A and the second separator 90B away from each other.

Figure 17:
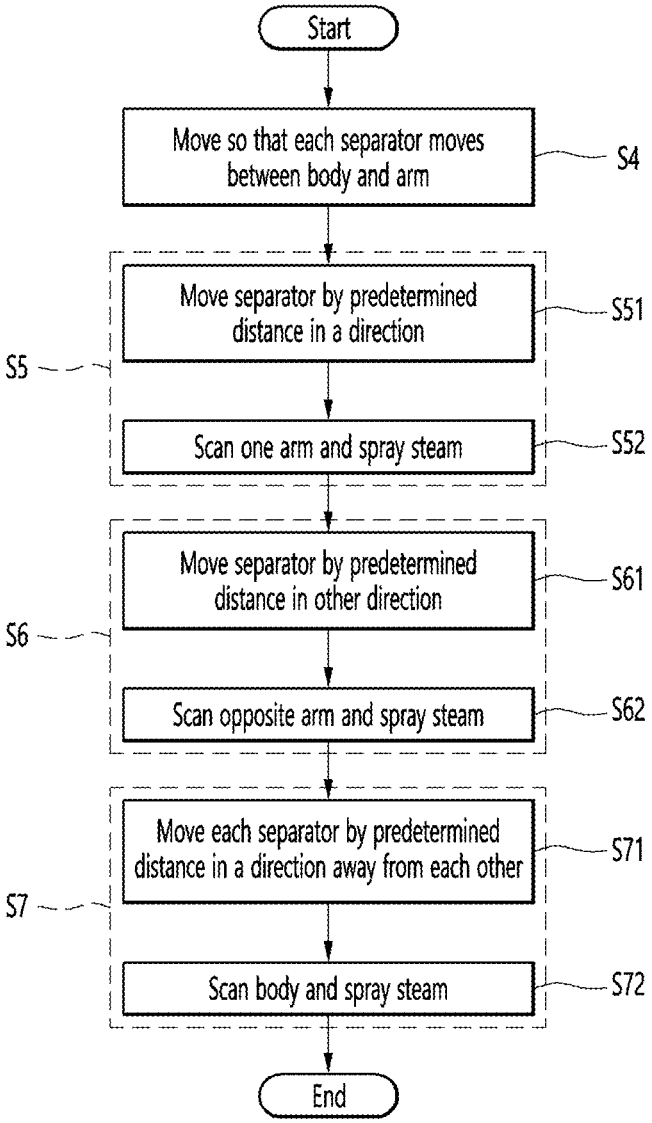
FIG. 17 is a flowchart illustrating an example of a method for controlling a clothing processing apparatus according to a second embodiment of the present disclosure.

FIG. 17 is a flowchart illustrating an example of a method for controlling a clothing processing apparatus according to a second embodiment of the present disclosure.

Hereinafter, a method for controlling the clothing processing apparatus according to the present embodiment will be described. The following control method may be performed in a state where the clothing supporter 20 on which the clothing C is hung is held on the holder 60.

The method for controlling the clothing processing apparatus according to the present embodiment may include a separation step S4, a first arm refreshing step S5, a second arm refreshing step S6, and a body refreshing step S7.

Unlike the method for controlling a clothing processing apparatus according to the first embodiment described above, preferably, the method for controlling a clothing processing apparatus according to the present embodiment may sequentially perform the first arm refreshing step S5, the second arm refreshing step S6, and the body refreshing step S7. This is because wrinkles may occur on the body C1 of the clothing C in the first arm refreshing step S5 and the second arm refreshing step S6.

In the separation step S4, the controller 80 controls the moving motor 100 and thus the first separator 90A and the second separator 90B can be moved in the opposite direction so that the first separator 90A and the second separator 90B, which were in the initial positions, are moved between the body C1 and the arm C2 and C3 of the clothing C. In this case, the first separator 90A can be moved between the body C1 and one of the arms C2 of the clothing C, and the second separator 90B can be moved between the body C1 and the other arm C3 of the clothing C.

The first arm refreshing step S5 may include a first arm alignment step S51 and a first arm scanning step S52.

In the first arm alignment step S51, the controller 80 may control each moving motor 100 to move the first separator 90A and the second separator 90B in one direction. In this case, one arm C2 of the clothing C may be separated from the body C1 to droop downward.

The first arm scanning step S52 may be performed after the first arm alignment step S51. In the first arm scanning step S52, the controller 80 may control the elevating motor 40 to elevate the steamer 30 and may spray steam from the steamer 30. Accordingly, the steamer 30 may refresh by scanning the one arm C2 which droops downward.

The second arm refreshing step S6 may include a second arm alignment step S61 and a second arm scanning step S62.

In the second arm alignment step S61, the controller 80 may control each moving motor 100 to move the first separator 90A and the second separator 90B in other directions. In this case, the other arm C3 of the clothing C may be separated from the body C1 to droop downward.

The second arm scanning step S62 may be performed after the second arm alignment step S61. In the second arm scanning step S62, the controller 80 may control the elevating motor 40 to elevate the steamer 30 and may spray steam from the steamer 30. Accordingly, the steamer 30 may refresh while scanning the other arm C3 which droops downward.

The body refreshing step S7 may include a body alignment step S71 and a body scanning step S72.

In the body alignment step S71, the controller 80 may control the moving motor 100 to move the first separator 90A and the second separator 90B in a direction away from each other. In this case, the body C1 of the clothing C may be separated from the arms C2 and C3 to droop downward.

The body scanning step S72 may be performed after the body alignment step S71. In the body scanning step S45, the controller 80 may control the elevating motor 40 to elevate the steamer 30 and may spray steam from the steamer 30. Accordingly, the steamer 30 may refresh the body C1 while scanning the tautly drooping body C1.

Figure 18:
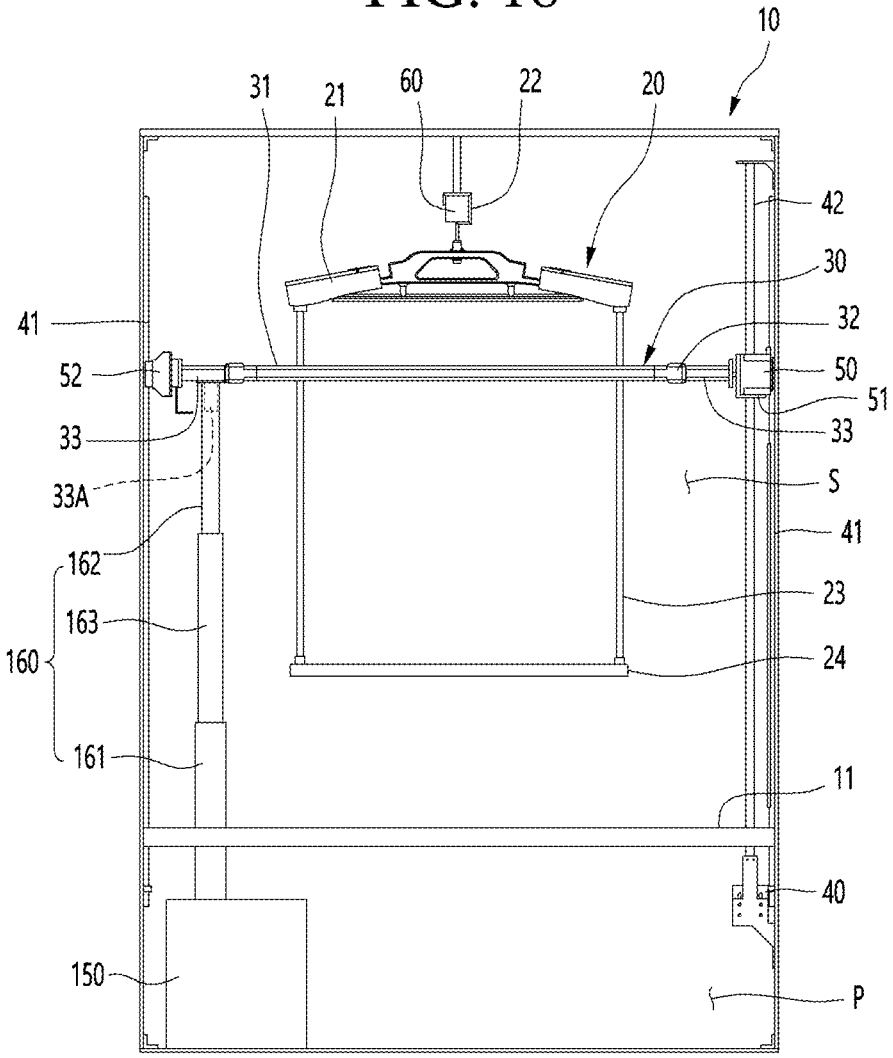
FIG. 18 is a front view illustrating a clothing processing apparatus according to a third embodiment of the present disclosure.
Figure 19:
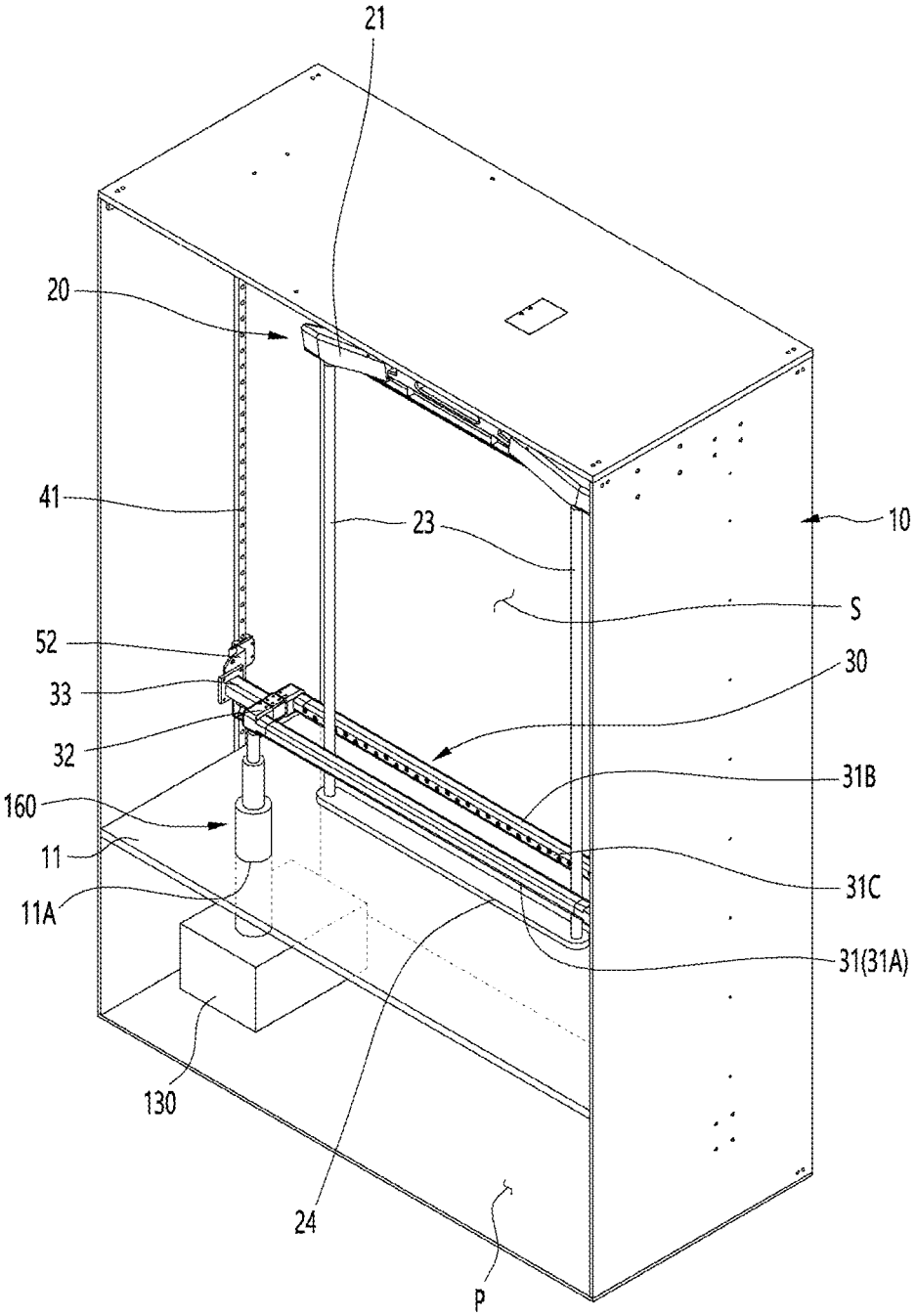
FIG. 19 is a perspective view illustrating a clothing processing apparatus according to a third embodiment of the present disclosure.

FIG. 18 is a front view illustrating a clothing processing apparatus according to a third embodiment of the present disclosure, and FIG. 19 is a perspective view illustrating a clothing processing apparatus according to a third embodiment of the present disclosure.

Hereinafter, contents that overlap with those described in the first embodiment above will be omitted and the differences therebetween will be mainly described.

A machine room P partitioned from the receiving space S may be further formed in the cabinet 10. The machine room P may be located below the receiving space S. The machine room P and the receiving space S may be partitioned by the partition plate 11. The partition plate 11 may be installed horizontally in the cabinet 10.

The elevating motor 40 may be disposed in the machine room P. In this case, the lead screw 42 may be formed long in the vertical direction from the machine room P to the receiving space S. A screw through-hole through which the lead screw 42 passes may be formed in the partition plate 11.

The clothing processing apparatus according to the present embodiment may include a steam generator 150.

The steam generator 150 may be disposed in the inner portion of the cabinet 10, in more detail, inside the machine room P.

The steam generator 150 may include a predetermined housing for storing water or passing water and a heater for heating the water inside the housing. Accordingly, the steam generator 150 may generate steam by heating water by the heater and supply steam to the steamer 30 through the steam guide tube 160. This will be described in detail later.

The steam guide tube 160 connected to the steam generator 150 may be fastened to the steam injector 33A. Accordingly, the steam generated by the steam generator 150 may be injected into the steamer 30.

The steam injector 33A may be rotatably fastened to the steamer 30. In more detail, the steam injector 33A may include a steamer connection part formed long in the same direction as that of the extension part 33 and rotatably fitted to the extension part 33, and a guide tube connection part which protrudes downward from the steamer connection part and to which the steam guide tube 160 is connected. In this case, the extension part 33 to which the steam injector 33A is fastened may include a first part connected to one side of the steamer connection part and a second part connected to the other side of the steamer connection part.

Accordingly, even if the steamer 30 is rotated by the driving of the rotation motor 50, the steam injector 33A may maintain a state of being connected to the steam guide tube 160 continuously toward the lower side.

Meanwhile, the steam guide tube 160 is formed long in the vertical direction and may connect the steam generator 150 and the steamer 30. The steam guide tube 160 may guide the steam generated by the steam generator 150 to the steam injector 33A of the steamer 30.

The steam guide tube 160 may be formed long in the vertical direction. Therefore, even if steam is condensed in the steam guide tube 160, the condensed water may fall to the steam generator 150 without being collected in the steam guide tube 160 and be reheated with steam.

A through-hole 11A through which the steam guide tube 160 passes may be formed in the partition plate 11.

The steam guide tube 160 may have a multi-stage structure with a variable length. In other words, the length of the steam guide tube 160 in the vertical direction may be varied according to the elevation of the steamer 30. The steam guide tube 160 may have a structure similar to that of an antenna with a variable length.

Accordingly, the steam guide tube 160 can always maintain in a vertical direction even when the steamer 30 elevates and smoothly guide the steam to the steamer 30.

In more detail, the steam guide tube 160 may include an inlet guide tube 161 connected to the steam generator 150 and an outlet guide tube 162 connected to the steamer 30. The steam guide tube 160 may further include a connection guide tube 163 connecting the inlet guide tube 161 and the outlet guide tube 162.

The inlet guide tube 161 and the outlet guide tube 162 may be directly connected. However, hereinafter, a case where the inlet guide tube 161 and the outlet guide tube 162 are connected by the connection guide tube 163 will be described as an example.

The steam generated by the steam generator 150 may lift and flow into the inlet guide tube 161. The inlet guide tube 161 may be formed long in the vertical direction.

The inlet guide tube 161 may pass through the through-hole 11A formed in the partition plate 11. However, the present disclosure is not limited thereto, and the inlet guide tube 161 is mounted on the upper surface of the partition plate 11 and may be connected to the steam generator 150 by a separate tube.

The outlet guide tube 162 may be connected to the steam injector 33A from the lower side of the steamer 30. The outlet guide tube 162 may be elevated together with the steamer 30.

The steam of the outlet guide tube 162 may lift and be injected into the steamer 30. The outlet guide tube 162 may be formed long in the vertical direction.

The connection guide tube 163 may communicate the inlet guide tube 161 and the outlet guide tube 162. The steam of the inlet guide tube 161 may pass through the connection guide tube 163 and lift to the outlet guide tube 162.

At least one connection guide tube 163 may be provided. For example, as illustrated in FIG. 1, in a case where there is one connection guide tube 163, the steam guide tube 160 may form a three-stage variable length structure. As another example, in a case where there are three connection guide tubes 163, the steam guide tube 160 may form a 5-stage variable length structure. A person skilled in the art will readily understand this.

Figure 20:
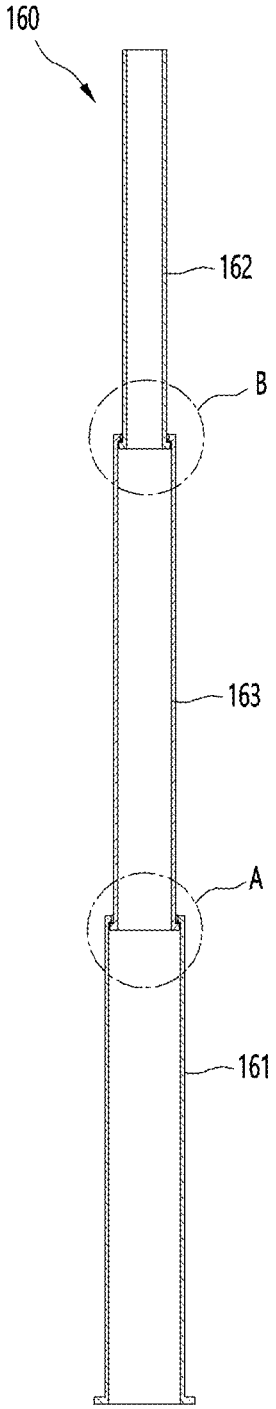
FIG. 20 is a cross-sectional view illustrating an inner portion of the steam guide tube according to the third embodiment of the present disclosure.
Figure 21:
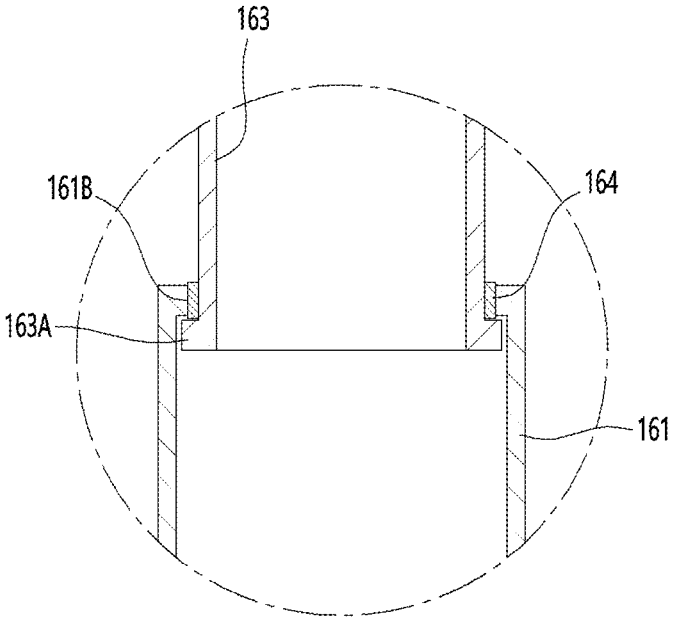
FIG. 21 is an enlarged view illustrating part 'A' of FIG. 20.
Figure 22:
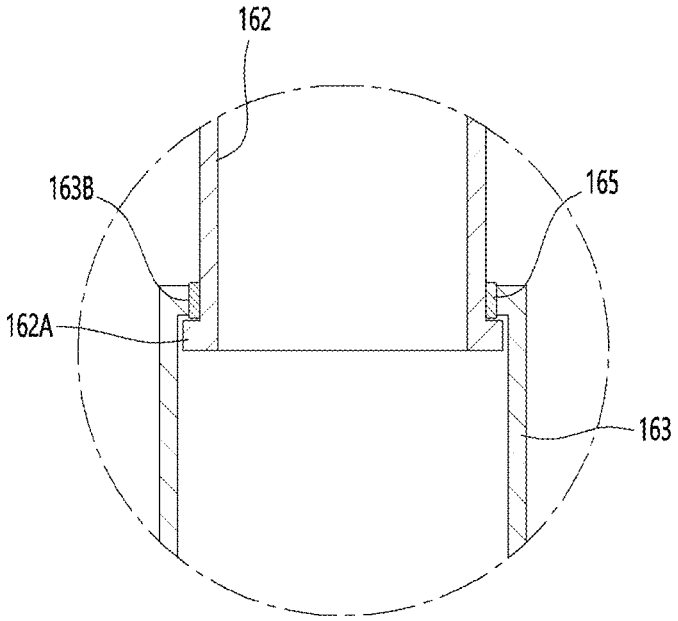
FIG. 22 is an enlarged view illustrating part 'B' of FIG. 20.

FIG. 20 is a cross-sectional view illustrating an inner portion of the steam guide tube according to the third embodiment of the present disclosure, FIG. 21 is an enlarged view illustrating part 'A' of FIG. 20, and FIG. 22 is an enlarged view illustrating part 'B' of FIG. 20.

As described above, the steam guide tube 160 may include an inlet guide tube 161, an outlet guide tube 162, and a connection guide tube 163.

The insides of the inlet guide tube 161, the outlet guide tube 162, and the connection guide tube 163 communicate with each other so that steam can lift smoothly.

Referring to FIG. 21, a first through-hole 161B through which the connection guide tube 162 passes may be formed at the upper end of the inlet guide tube 161.

The connection guide tube 163 may move in the vertical direction with respect to the inlet guide tube 162 through the first through-hole 161B. In other words, the connection guide tube 163 may move in the vertical direction to be received in the inlet guide tube 161 or may protrude long above the inlet guide tube 161.

The inner diameter of the inlet guide tube 161 may be greater than the outer diameter of the connection guide tube 163. In other words, a predetermined tolerance may be formed between the inner circumference of the inlet guide tube 161 and the outer circumference of the connection guide tube 163, and the connection guide tube 163 can move in the vertical direction smoothly with respect to the inlet guide tube 161 due to the tolerance.

A first sealing 164 in contact with the outer circumference of the connection guide tube 163 may be provided on the inner circumference of the first through-hole 161B. The first sealing 164 may include an elastic material such as rubber or silicone. The first sealing 164 may have an O-ring shape.

The first sealing 164 may prevent steam from leaking into a gap between the inner circumference of the inlet guide tube 161 and the outer circumference of the connection guide tube 163. In addition, the first sealing 164 may support the connection guide tube 163 in the horizontal direction and assist the connection guide tube 163 to move vertically while maintaining a vertical position with respect to the inlet guide tube 161.

A first hanging part 163A hung on the lower peripheral portion of the first through-hole 161B may be formed on the lower end of the connection guide tube 163.

The first hanging part 163A may be formed to protrude or extend radially outward from the outer circumference of the lower end portion of the connection guide tube 163. A predetermined tolerance may be formed between the first hanging part 163A and the inner circumference of the inlet guide tube 161.

The diameter of the first through-hole 161B formed at the upper end of the inlet guide tube 161 may be smaller than the inner diameter of the inlet guide tube 161. In other words, the inner circumference of the inlet guide tube 161 and the inner circumference of the first through-hole 161B may be formed to have a step difference from each other in the vertical direction.

The first hanging part 163A may be hung on a portion connecting the inner circumference of the inlet guide tube 161 and the inner circumference of the first through-hole 161B. Accordingly, it is possible to prevent the connection guide tube 163 from being completely separated from the inlet guide tube 161 by lifting of the connection guide tube.

Meanwhile, referring to FIG. 22, a second through-hole 163B through which the outlet guide tube 162 passes may be formed at the upper end of the connection guide tube 163.

The outlet guide tube 162 may move in the vertical direction with respect to the connection guide tube 163 through the second through-hole 163B. In other words, the outlet guide tube 162 may move in the vertical direction to be received in the connection guide tube 163 or protrude long above the outlet guide tube 163.

The inner diameter of the connection guide tube 163 may be greater than the outer diameter of the outlet guide tube 162. In other words, a predetermined tolerance may be formed between the inner circumference of the connection guide tube 163 and the outer circumference of the outlet guide tube 162, and the outlet guide tube 162 can move in the vertical direction smoothly with respect to the connection guide tube 163 due to the tolerance.

A second sealing 165 in contact with the outer circumference of the outlet guide tube 162 may be provided on the inner circumference of the second through-hole 163B. The second sealing 165 may include an elastic material such as rubber or silicone. The second sealing 164 may have an O-ring shape.

The second sealing 165 may prevent steam from leaking into a gap between the inner circumference of the connection guide tube 163 and the outer circumference of the outlet guide tube 162. In addition, the second sealing 165 may support the outlet guide tube 162 in the horizontal direction and assist the outlet guide tube 162 to move in the vertical direction while maintaining a state of being vertical with respect to the connection guide tube 163.

A second hanging part 162A hung on the lower end circumferential portion of the second through-hole 163B may be formed on the lower end of the outlet guide tube 162.

The second hanging part 162A may be formed to protrude or extend radially outward from the outer circumference of the lower end portion of the outlet guide tube 163. A predetermined tolerance may be formed between the inner circumference of the connection guide tube 163 and the second hanging part 162A.

The diameter of the second through-hole 163B formed at the upper end of the connection guide tube 163 may be smaller than the inner diameter of the connection guide tube 163. In other words, the inner circumference of the connection guide tube 163 and the inner circumference of the second through-hole 163B may be formed to be stepped from each other in the vertical direction.

The second hanging part 162A may be hung on a portion connecting the inner circumference of the connection guide tube 163 and the inner circumference of the second through-hole 163B. Accordingly, it is possible to prevent the outlet guide tube 162 from being completely separated from the connection guide tube 162 by lifting.

Hereinafter, the operation of the steam guide tube 160 according to the present embodiment will be described.

Steam generated in the steam generator 150 may lift and flow into the steam guide tube 160. The steam flowing into the steam guide tube 160 may sequentially pass through the inlet guide tube 161, the connection guide tube 163, and the outlet guide tube 162 to be injected into the steamer 130.

When the steamer 30 lifts by the driving of the elevating motor 40, the outlet guide tube 162 coupled to the steamer 30 lifts together with the steamer 30. In this case, as the outlet guide tube 162 protrudes above the second through-hole 163B of the connection guide tube 163, the length of the steam guide tube 160 may be increased.

When the steamer 30 continues to lift and the second hanging part 162A of the outlet guide tube 162 is hung around the lower end portion of the second through-hole 163B of the connection guide tube 163, the length of the steam guide tube 160 may be longer as the connection guide tube 163 protrudes above the first through-hole 161B of the inlet guide tube 161.

The steamer 30 may lift until the first hanging part 163A of the connection guide tube 163 is hung around the lower end portion of the first through-hole 161B of the inlet guide tube 161.

Conversely, when the steamer 30 lowers by driving the elevating motor 40, the outlet guide tube 162 fastened to the steamer 30 lowers together with the steamer 30. In this case, since the connection guide tube 163 is inserted into the inlet guide tube 161 through the first through-hole 161B of the inlet guide tube 161, the length of the steam guide tube 160 may be reduced.

When the steamer 30 continues to lower and the connection guide tube 163 is completely received in the inlet guide tube 161, the length of the steam guide tube 160 may be further reduced by inserting the outlet guide tube 162 into the connection guide tube 163 through the second through-hole 163B of the connection guide tube 163.

The steamer 30 may lower until the second hanging part 162A of the outlet guide tube 162 is completely received in the connection guide tube 163.

Figure 23:
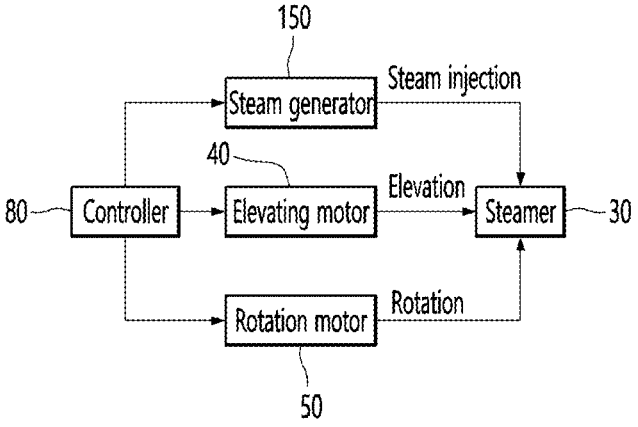
FIG. 23 is a control block diagram illustrating a clothing processing apparatus according to a third embodiment of the present disclosure.

FIG. 23 is a control block diagram illustrating a clothing processing apparatus according to a third embodiment of the present disclosure.

The controller 80 according to the present embodiment may control the elevating motor 40, the rotation motor 50, and the steam generator 150 described above.

The controller 80 may control the elevating motor 40 to elevate the steamer 30. Also, the controller 80 may control the rotation motor 50 to rotate the steamer 30. Also, the controller 80 may control the steam generator 150 to supply steam to the steamer 30.

The controller 80 may simultaneously control the elevating motor 40 and the rotation motor 50 to combine elevating and rotating operations of the steamer 30 to spray steam onto the clothing C in various ways.

According to a preferred embodiment of the present disclosure, in a state where the arms droop downward, the steamer can spray the steam by elevating. In this way, the clothing can be refreshed without wrinkles on the arms.

In addition, since the scan directions of the body and arms of the clothing are the same, the same single steamer can be used. Accordingly, the configuration of the clothing processing apparatus can be simplified.

In addition, since the arm is spread by drooping downward, the clothing processing apparatus can be compact compared to the conventional method in which the arm is spread by directly applying a mechanical force to the arm. Therefore, there is an advantage suitable for using the clothing processing apparatus for home use.

In addition, since the alignment and scanning of the body and arms of the clothing are automatically performed, there is an advantage in that the user's convenience is increased.

In the case of an embodiment in which the arm droops by rotating the holder, since the side frame of the clothing supporter supports the body of the clothing from the inside, the body of the clothing may not droop downward even if the holder rotates. Thereby, the arm of the clothing can be easily separated from the body.

In addition, the scan can be performed with a steamer in a state where one arm of clothing droops downward, the scan can be performed with a steamer in a state where the other arm of clothing droops downward, and scan can be performed with a steamer in a state where the body of clothing droops downward. Accordingly, each of the body and both arms of the clothing can be refreshed without wrinkles.

In the case of another embodiment in which the arm droops by moving the separator in the left and right direction, there is an advantage that a general clothing supporter (clothing hanger) not including a side frame can be used.

In addition, since the separate part of the separator is formed long in the front and rear direction, it may not be separated between the body and the arm of the clothing.

In the case of an embodiment including a steam guide tube, the steam guide tube may be disposed long in a vertical direction and have a variable length. Accordingly, the steamer can be smoothly elevated, and there is an advantage that water condensed in the steam guide tube does not accumulate in the steam guide tube.

In addition, the steam generator may be located below the steamer and the steam guide tube. Accordingly, water condensed in the steam guide tube may fall to the steam generator and be reheated with steam.

In addition, the steam guide tube may have a multi-stage structure including an inlet guide tube, an outlet guide tube, and a connection guide tube. Accordingly, the steam guide tube can be varied in length while maintaining in the vertical direction.

In addition, the first sealing and the second sealing may prevent steam passing through the steam guide tube from leaking out and may assist in vertical movement of the connection guide tube and the outlet guide tube.

In addition, it is possible to prevent the connection guide tube from being separated from the inlet guide tube by the first hanging part, and it is possible to prevent the outlet guide tube from being separated from the connection guide tube by the second hanging part.

In addition, a through-hole through which the steam guide tube passes may be formed in the partition plate. Thereby, the steam guide tube can be easily extended from the machine room to the receiving space.

What is claimed is:

1. A clothing processing apparatus comprising:

a cabinet having a receiving space formed therein, in which clothing is received;

a holder configured to be located in the receiving space to hold a clothing supporter configured to support the clothing;

a steamer configured to spray steam toward the clothing while elevating inside the receiving space in the vertical direction;

an elevating motor configured to provide an elevating power of the steamer; and a tilting motor configured to rotate the holder so that an arm of the clothing droops downward to be separated from a body of the clothing.

2. The clothing processing apparatus of claim 1, wherein the clothing supporter includes:

a hanging part on which clothing is hung, a ring configured to suspend the hanging part on the holder so that h clothing supporter rotates together with the holder, and a side frame configured to extend downward from the hanging part and to support both sides of the body of the clothing from an inner portion thereof.

3. The clothing processing apparatus of claim 1, further comprising:

a controller configured to control the tilting motor to rotate the holder in a direction in which the arm of the clothing droops downward and to control the elevating motor so that the steamer elevates in a state where the arm of the clothing droops downward.

4. A method for controlling a clothing processing apparatus, comprising:

a first arm alignment step of rotating a holder in one direction so that one arm of both arms of a clothing that is hung on a clothing supporter is separated from a body of the clothing and droops downward;

a first arm scanning step in which a steamer sprays steam while elevating in the vertical direction in a state where the one arm droops downward;

a second arm alignment step in which the holder rotates in another direction so that the another arm of both arms of the clothing is separated from the body and droops downward; and a second arm scanning step in which the steamer sprays steam while elevating in the vertical direction in a state where the another arm droops downward.

5. The method for controlling a clothing processing apparatus of claim 4, further comprising:

a body scanning step in which the steamer sprays steam while elevating in the vertical direction in a state where the body of the clothing droops downward, wherein the body scanning step is performed before the first arm alignment step or performed after the second arm scanning step.

6. A clothing processing apparatus comprising:

a cabinet having a receiving space formed therein, in which clothing is received;

a holder configured to be located in the receiving space to hold a clothing supporter configured to support the clothing;

a steamer configured to spray steam toward the clothing while elevating inside the receiving space in the vertical direction;

an elevating motor configured to provide an elevating power of the steamer;

a separator configured to move in the left and right direction and to move between a body and arms of the clothing to separate the body and arms of the clothing; and a moving motor that moves the separator in the left and right direction.

7. The clothing processing apparatus of claim 6, wherein the separator comprises a pair of separators spaced apart from each other in the left and right direction.

8. The clothing processing apparatus of claim 6, wherein the separator includes:

a moving body configured to move in the left and right direction by the moving motor;

a moving bar formed long upward from the moving body; and a separate part located at the upper end of the moving bar and formed long in the front and rear direction.

9. The clothing processing apparatus of claim 8, further comprising:

a guide rail configured to be disposed long on the inner bottom surface of the cabinet in the left and right direction to guide the movement of the moving body in the left and right direction.

10. The clothing processing apparatus of claim 9, wherein the moving body includes:

a main body to which the moving bar is connected; and a guide block positioned below the main body and having a guide groove into which the guide rail is fitted formed therein.

11. The clothing processing apparatus of claim 6, further comprising:

a rotation pulley configured to be connected to the moving motor;

a support pulley configured to be spaced apart from the rotation pulley; and a belt configured to be connected to the rotation pulley and the support pulley to form a closed curve, wherein the separator is provided with a belt holder for holding the belt.

12. The clothing processing apparatus of claim 6, further comprising:

a controller configured to control the moving motor to separate one arm from the body of the clothing and to control the elevating motor to elevate the steamer in a state where the one arm is separated from the body.

13. A method for controlling a clothing processing apparatus, comprising:

a separation step in which a pair of separators move in a direction away from each other and respectively move between arms and a body of a clothing;

a first arm alignment step of moving at least one of the pair of separators in one direction so that one arm of the clothing is separated from the body and droops downward;

a first arm scanning step in which a steamer sprays steam while elevating in the vertical direction in a state where the one arm is separated from the body and droops downward;

a second arm alignment step of moving at least one of the pair of separators in another direction so that another arm of the clothing is separated from the body and droops downward; and a second arm scanning step in which the steamer sprays steam while elevating in the vertical direction in a state where the another arm is separated from the body and droops downward.

14. The method for controlling a clothing processing apparatus of claim 13, further comprising:

a body alignment step in which the pair of separators moves in a direction away from each other so that the body of the clothing is separated from both arms and droops downward; and a body scanning step in which the steamer sprays steam while elevating in the vertical direction in a state where the body is separated from both arms.

15. The method for controlling a clothing processing apparatus of claim 14, wherein the body alignment step is performed after the second arm scanning step.

16. A clothing processing apparatus comprising:

a cabinet having a receiving space formed therein, in which clothing is received;

a steamer configured to spray steam toward the clothing while moving inside the receiving space in the vertical direction;

an elevating motor configured to provide an elevating power of the steamer;

a steam generator configured to be positioned below the steamer and to generate steam supplied to the steamer; and a steam guide tube which is formed long in the vertical direction, connects the steam generator and the steamer, and the length of which varies according to the elevation of the steamer, wherein the steam guide tube includes:

an inlet guide tube connected to the steam generator;

an outlet guide tube connected to the steamer and configured to elevate together with the steamer; and a connection guide tube configured to connect the inlet guide tube and the outlet guide tube and to move with respect to the inlet guide tube and the outlet guide tube in the vertical direction, wherein an inner diameter of the inlet guide tube is greater than an outer diameter of the connection guide tube, and wherein an inner diameter of the connection guide tube is greater than an outer diameter of the outlet guide tube.

17. The clothing processing apparatus of claim 16, wherein the steam guide tube has a multi-stage structure of variable length.

18. The clothing processing apparatus of claim 16, wherein a first through-hole through which the connection guide tube passes is formed on an upper end of the inlet guide tube, and wherein a second through-hole through which the outlet guide tube passes is formed on an upper end of the connection guide tube.

19. The clothing processing apparatus of claim 18, wherein a first sealing member in contact with the outer circumference of the connection guide tube is provided on an inner circumference of the first through-hole, and wherein a second sealing member in contact with the outer circumference of the outlet guide tube is provided on an inner circumference of the second through-hole.

* * * * *